US008162277B2

(12) United States Patent
Russell

(10) Patent No.: US 8,162,277 B2
(45) Date of Patent: Apr. 24, 2012

(54) ATTACHMENT APPARATUS FOR STUDIO EQUIPMENT AND THE LIKE

(75) Inventor: Clive Russell, West Palm Beach, FL (US)

(73) Assignee: Quicklip LLC, West Palm Beach, FL (US)

( * ) Notice: Subject to any disclaimer, the term of this patent is extended or adjusted under 35 U.S.C. 154(b) by 0 days.

(21) Appl. No.: 12/966,646

(22) Filed: Dec. 13, 2010

(65) Prior Publication Data

US 2011/0280007 A1 Nov. 17, 2011

Related U.S. Application Data

(62) Division of application No. 11/689,942, filed on Mar. 22, 2007, now Pat. No. 7,850,136.

(51) Int. Cl.
*E04G 3/00* (2006.01)
*A47G 1/10* (2006.01)

(52) U.S. Cl. ..... 248/316.5; 248/274.1

(58) Field of Classification Search ..... 248/316.5, 248/274.1

See application file for complete search history.

(56) References Cited

U.S. PATENT DOCUMENTS

| | | | | |
|---|---|---|---|---|
| 3,452,955 | A | 7/1969 | Hartwig | |
| 4,040,547 | A | 8/1977 | Dickey | |
| 4,466,596 | A | 8/1984 | Cohen | |
| 4,678,153 | A | 7/1987 | Maddock et al. | |
| 4,702,447 | A * | 10/1987 | Westwood, III | 248/231.51 |
| D299,906 | S | 2/1989 | Greulich | |
| 4,811,405 | A | 3/1989 | Peiker | |
| D305,026 | S | 12/1989 | Wolf | |
| D327,211 | S | 6/1992 | Tarshis et al. | |
| 5,276,949 | A | 1/1994 | Cordellini | |
| 5,322,251 | A | 6/1994 | Schumer et al. | |
| 5,341,276 | A * | 8/1994 | Shen | 362/648 |
| 5,735,499 | A | 4/1998 | Phillips et al. | |
| 5,806,821 | A | 9/1998 | Phillips et al. | |
| 6,305,654 | B1 | 10/2001 | Schmidt et al. | |
| 2004/0218982 | A1 * | 11/2004 | Wentworth et al. | 405/184.3 |
| 2006/0260132 | A1 | 11/2006 | Schmode | |

* cited by examiner

*Primary Examiner* — Terrell McKinnon
*Assistant Examiner* — Erin W Smith
(74) *Attorney, Agent, or Firm* — Gerry J. Elman; Elman Technology Law, P.C.

(57) ABSTRACT

Mounting brackets for mounting microphones, lights, video, audio and photographic tools and accessories utilized in the audio/video industry to a variety of support structures or fixtures. This invention provides quick and effective attachment of numerous audio/video devices and other paraphernalia onto a wide variety of fixtures. Convenient clamping and mounting mechanisms are disclosed, as well as a kit of such mechanisms.

5 Claims, 20 Drawing Sheets

ATTACHMENT APPARATUS FOR STUDIO EQUIPMENT AND THE LIKE

CROSS-REFERENCE TO RELATED APPLICATIONS

This application is a divisional of and claims priority under 35 U.S.C. §120 to U.S. patent application Ser. No. 11/689,942, filed Mar. 22, 2007, issuing as U.S. Pat. No. 7,850,136, Dec. 14, 2010. The entire contents of the aforementioned patent application are incorporated herein by reference.

FIELD OF THE INVENTION

This invention relates to mounting brackets for mounting microphones, lights, video, audio and photographic tools and accessories utilized in the audio/video industry to a variety of support structures or fixtures.

BACKGROUND OF THE INVENTION

Numerous mounting brackets and holders exist to provide mounting of video and/or audio equipment to a support structure. However, most brackets are designed for only one mounting position and cannot function outside that position. This fact is particularly disadvantageous to the individual who requires the flexibility to set up audio or video equipment in various "field" settings. I perceive the need for a versatile mounting bracket that makes it easy for such equipment to be quickly mounted to almost any object in any location.

SUMMARY OF THE INVENTION

In one aspect of the present invention, a mounting device for microphones, lights, video, audio, and photographic tools and accessories is provided, with the versatility to mount to almost any fixture. It is common for those involved in video, audio and photography production to be challenged with the need for innovative methods of mounting microphones and lights in studios and remote locations. Although known devices and apparatus utilized in this area are suitable for their respective specific purposes, a need remains for a device that will work well in multiple situations. Furthermore, there is a need for a device of this type that is cost-effective and space-saving.

This invention is directed to facilitate the methods in which microphones, lights, and other video and audio accessory equipment are set up to be utilized in the field. This invention provides an effective method of attaching various audio/video devices onto a wide variety of fixtures. The use with microphones is but one of various uses within the general application of the invention. The description below of microphone mounting is not intended to limit the applicability of the invention, but rather to demonstrate one of a variety of applications.

The present invention provides a mounting bracket with means for rapidly and conveniently detachably mounting a microphone or other object onto any of many readily accessible uniform and/or non-uniform objects such as a tree, pole, drop ceiling, door, handle, knob, etc. An advantage of the invention is to accomplish this purpose without tape, wire or other ad hoc methods otherwise needed to support such objects.

The mounting bracket comprises a pair of opposing support clips, or clamping members, pivotally attached to a connecting means, such as an adjustment screw with a pin, a spring and a circular body ("body") with a tapered end and a threaded end. The tapered end of the body provides an interface to accept the adjustment screw, which serves as a connecting means between the circular body and support clips. The support clips pivotally attach to the adjustment screw. One end of each support clip slidably engages the tapered end of the body, while the other end of the pair of clips act as jaws that clamp about a support structure. The threaded end of the body provides an interface for a conventional microphone holder to attach to the mounting bracket.

In operation, the user rotates the body while the support clips and adjustment screw are held stationary. The adjustment screw and slidable ends of the support clips raise or lower in relation to the tapered end of the body. This action causes the jaws of the support clips to open or close respectively. The spring biases the support clips open as the body is rotated to extend the adjustment screw.

To use the mounting bracket, the user screws the threaded end of the body onto a conventional microphone holder. The user then rotates the body in a right-to-left direction while holding the support clips and adjustment screw stationary. The adjustment screw extends in relation to the body. The ends of the support clips travel upwardly along the tapered end causing the jaws to open. The spring biases the jaws open so the jaws may engage a support structure, such as the rail of a typical drop ceiling. Once the jaws are in position to engage the support structure, the user rotates the body in a left-to-right direction, which retracts the adjustment screw into the body. The ends of the support clips travel downwardly along the tapered end, causing the jaws to close about the support structure. After the mounting bracket securely attaches to the support structure, the microphone slidably attaches to the microphone holder. The microphone is securely attached to a support structure, which, in the absence of a mounting bracket of this invention, may not have been usable to efficiently support the microphone.

In one embodiment, the mounting bracket may attach a microphone to almost any support structure up to one inch in width or diameter. In an alternate embodiment, the mounting bracket may attach a microphone to almost any support structure up to two inches in width or diameter. In either embodiment, the mounting bracket has the capability of attaching to uniform or non uniform objects such as trees, poles, drop ceilings, pipes, doors, handles and knobs, to name just a few typical examples.

Accessories, desirably integrated into a kit of this invention, are designed specifically to cooperate with the mounting bracket to be even more versatile in its mounting applications. The accessories are: a desktop (desk stand) plate, a light stand (portable light adapter), a camera mounting adapter, universal joint (adjustable mounting bracket), drop ceiling light assembly, and a hook. The desk stand plate assembly allows a microphone to be positioned on a flat surface, such as a desk, when no other object is available on which the mounting bracket may clamp. The plate assembly has a weighted flat base and an integrated support, such as a tee ("T") or channel mount ("U") on to which the mounting bracket may clamp.

The shoe mount adapter of this invention allows users to attach a microphone to a video camera or other piece of video equipment. This adapter attaches to the shoe mount of the video equipment, and the mounting bracket clamps to the adapter.

The portable light adapter of this invention is designed to support accessory lighting on stand-alone systems, and cameras and camcorders when used in conjunction with the camera mount adapter. The attachment is capable of supporting small portable lights.

The universal joint (adjustable mounting bracket) of this invention provides 360 degrees of rotational ability and 90 degrees of tilt to the microphone adapter on one end and a mounting bracket on the other end.

The drop-ceiling light assembly of this invention is designed to mount on a ceiling track.

The hook of the invention is designed to thread onto the threaded end of the body of the mounting bracket. In this manner, the user has a convenient hook that can be attached almost anywhere to hang such accessories as audio or video, wiring, lighting, etc. Multiple hooks can be used to mount a sign or picture from a ceiling.

From the foregoing, taken with the following detailed description, it becomes apparent that this invention provides an improved device that will allow an individual to attach video, audio, and photographic tools and accessories to multiple fixtures and equipment. A feature of the invention is its versatility to function on many surfaces for many different applications. It has applications for a range of users: from the hobbyist, attaching equipment to pipes and the drop ceiling in the basement, to the professional on the road, who needs a quick and easy method to attach equipment to a wide range of objects. One aspect of this invention provides a versatile mounting bracket that is capable of mounting a microphone on almost any object up to two inches. Another aspect of this invention involves a microphone mounting kit having interrelated parts adapted to be assembled in the field to provide a mounting for a microphone on almost any available object up to five feet in diameter.

The present invention provides a mounting bracket for conveniently mounting audio, video, lighting, and film accessories on a support structure. In one aspect, the mounting bracket comprises a body having a tapered end and a threaded end, the tapered end having a threaded hole, and the threaded hole extending into the body. A threaded adjustment screw is engaged in the threaded hole. A pair of opposing clamping members pivotally connects to the adjustment screw, with each clamping member having a bottom end, and a jaw at the opposite end. The bottom end of each clamping member slides along the tapered end of the body, thereby moving the jaw into an opened position with the adjustment screw extended and a closed position with the adjustment screw retracted.

The present invention further provides an embodiment in which a spring pivotally connects to the adjustment screw and biases open the clamping members.

The present invention further provides an embodiment in which the body of the mounting bracket has a knurled portion.

The present invention further provides an embodiment in which the clamping members of the bracket are coated, e.g. with enamel.

The present invention further provides an embodiment in which a microphone holder is attached to the threaded end of the mounting bracket.

The present invention further provides an embodiment in which a hook is attached to the threaded end of the mounting bracket.

The present invention further provides an embodiment in which a light adapter is attached to the threaded end of the mounting bracket.

The present invention further provides an embodiment in which a desk stand plate assembly provides means for clamping the mounting bracket. The desk stand plate is comprised of a base plate, a support structure attached to the base plate, and a fastening means for fastening the support structure to the base plate.

The present invention further provides an embodiment in which the support structure of the desk stand plate comprises a "T" element.

The present invention further provides an embodiment in which the support structure of the desk stand plate comprises a "U" element.

The present invention further provides a clamp for mounting a mounting bracket. The clamp has a C-shaped frame, having an elongated segment, and first and second short segments, a threaded hole in the first short segment of the C-shaped frame, a threaded rod protruding through the threaded hole, with the threaded rod having a handle on one end, and a flat base on the other end. A base plate connects to the outer side of the elongated segment of the C-shaped frame.

The present invention further provides an embodiment in which a side plate is connected to the outer side of the second short segment of the C-shaped frame.

The present invention further provides an adjustable mounting bracket. The adjustable mounting bracket has a circular body, having a first ball-shaped fixture at one end;

a microphone adaptor, having a second ball-shaped fixture at one end;

a universal block having a first half and a second half, and two notched ends for receiving the first and second ball-shaped fixtures;

a threaded screw having a bar knob at the distal end, the threaded screw connecting a bar knob, threadedly engaging the first half and second half of the universal bock; thereby clamping the notches of the universal block onto each of the ball-shaped fixtures, and providing an adjustable mounting bracket.

The present invention further provides a shoe mount adapter, comprising a plate;

a microphone holder attached to the plate;

a cable holder attached to said microphone holder;

a shoe mount guide attached to the plate;

a shoe mount attached to the plate, opposite of the shoe mount guide;

whereby the shoe mount adapter provides means for attaching a shoe mount device and a microphone, and fastening a microphone cable, conveniently close to a shoe mount of a camera.

The present invention further provides a wireless microphone adapter, comprising a cylinder. The cylinder is attached to a plate along the longitudinal axis of the cylinder, and has a fastener securely attached to the outer side of the plate. The fastener receives a complementary fastener of a wireless microphone, thus providing a secure mounting for a wireless microphone.

The present invention further provides a drop ceiling light assembly, comprising:

a light cover;

a curved shaft having a first end and a second end;

a mounting bracket having an adjustment screw; and a linear shaft extension having a first end and a second end;

wherein the first end of the linear shaft extension is attached to a ceiling-mounted electrical box, and the second end of the linear shaft extension is attached to the first end of the curved shaft, the light cover is attached to the second end of the curved shaft, and the mounting bracket is attached to the light cover, thereby providing a means for quick installation of a multiple ceiling-mounted light.

The present invention further provides an embodiment in which the light cover is dome shaped.

The present invention further provides a kit for conveniently mounting audio, video, lighting, and film accessories on a support structure comprising:

at least one mounting bracket;

at least one desk stand plate assembly;

at least one clamp;

at least one adjustable mounting bracket; and at least one shoe mount adapter.

The present invention further provides a method of hanging a sign from a drop ceiling comprising the step of attaching to rails of a drop ceiling a plurality of mounting brackets having hooks. This is followed by a step of attaching suspension means from the sign to the hooks of each mounting bracket.

Furthermore, another aspect of this invention provides a versatile mounting bracket that requires no modification of the typical professional microphone or its holder. Yet another aspect of this invention eliminates the need for tape, wire and other haphazard methods to mount microphones. An advantage of this invention is that it is easy to install without the use of tools. Another advantage of this invention is that it has applications from the hobbyist to the professional in audio and video fields. Other aspects of the invention will be apparent from a description of certain preferred embodiments below and as recited in the appended claims.

DETAILED DESCRIPTION

Embodiments of the invention shown in the accompanying drawings are now described in detail. They exemplify and teach those skilled in the art how to make and use the inventive concepts described above and recited in the claims appended below.

Figure 1:
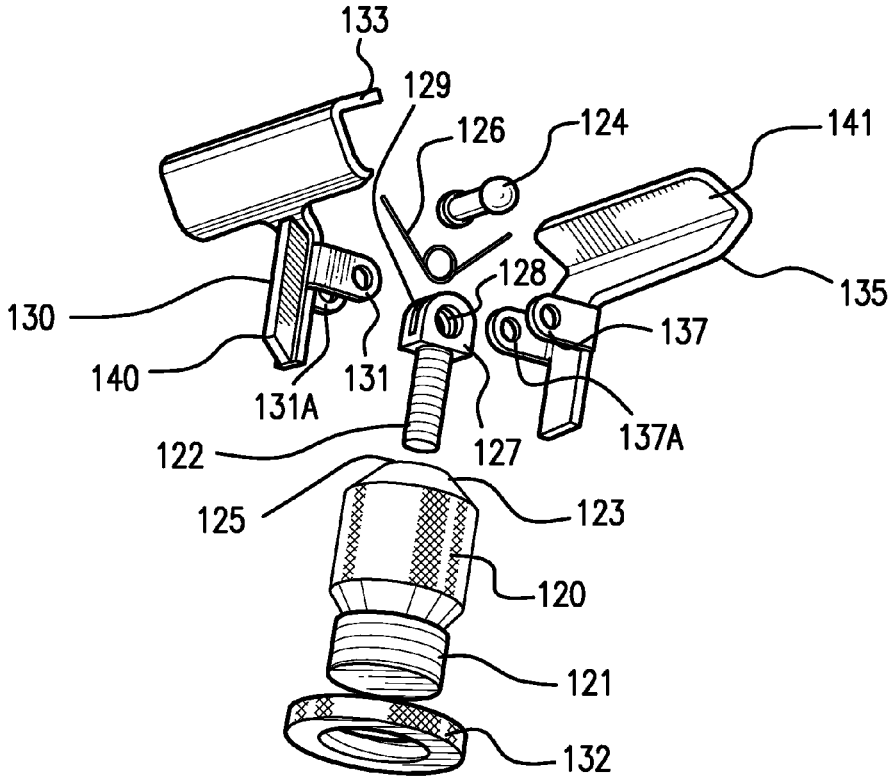
FIG. 1 is an exploded view of a mounting bracket of this invention.

FIGS. 1 and 2 illustrate the elements that comprise the mounting bracket 100, adapted for mounting a microphone on almost any object up to, e.g., two inches in diameter. The mounting bracket 100 includes a circular body 120, having a threaded end 121, for receiving a microphone holder, and a tapered end 123, a threaded adjustment screw 122, a set pin 124, a spring 126, and two support clips 130 and 135, each with a jaw 133 and 141 respectively for attaching the mounting bracket 100 to a support structure. The foundation of the mounting bracket 100 is the body 120 with a tapered end 123.

In one embodiment, the "light-duty" embodiment, the overall length of body 120 is approximately 1¼ inch long, and at its widest point, ¾ inch in diameter. Body 120 is preferably constructed from aluminum, although alternative materials such as stainless steel or iron may be used. About 3/16 inch from its top, circular body 120 tapers inward at about a 37-degree angle until the diameter at the top of tapered end 123 is about ¼ inches. The top of tapered end 123 is centered about the diameter of body 120. At the top of tapered end 123, a threaded hole 125, about ⅞ inch long and capable to accept a #10-32 screw, is drilled and tapped into the center of body 120. Tapered end 123 is finished smooth to allow the ends of support clips 130 and 135 to slide up and down the tapered end 123. The body 120 is knurled from below tapered end 123 for about 9/16 inch. The knurled area allows an individual to firmly grasp and rotate body 120 to open or close support clips 130 and 135.

Below the knurled area, body 120 tapers inward at about a 54-degree angle until the diameter of body 120 is about ½ inch. The remaining ⅜ inch of body 120 comprises the threaded end 121. Threaded end 121 is an external 27 UNF thread. The threaded end receives a corresponding internally 27 UNF threaded end of a microphone holder.

The body 120 may be of any convenient shape that provides a tapered end 123 on which the ends of support clips 130 and 135 may slide up and down and a threaded end 121 to receive a microphone holder. In preferred embodiments, the body 120 is generally cylindrical for ease of rotation.

Figure 3A:
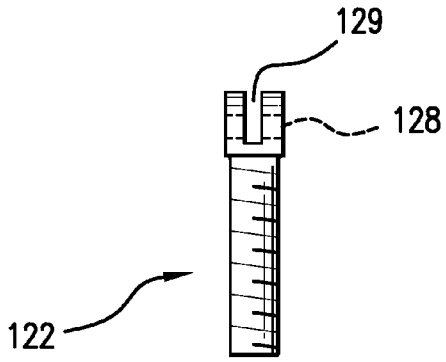
FIG. 3A is an elevation view of an adjustment screw.
Figure 3B:
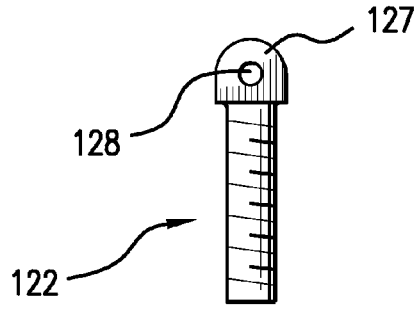
FIG. 3B is another elevation view of an adjustment screw.

An adjustment screw 122, as illustrated in FIGS. 3A and 3B, is preferably made from stainless steel and threads into body 120 via hole 125. Adjustment screw 122 is about 1⅛ inch long, of which about ⅞ inch is threaded #10-32 to correspond to hole 125. Adjustment screw 122 terminates in a flat-sided bulbous head 127 opposite the threaded end. A hole 128, about ⅛ inch in diameter, is centrally located in head 127, perpendicular to the flat side. A vertical slot 129, about 1/32 inch wide, extends perpendicular to hole 128 through screw head 127 and terminates just below hole 128. Slot 129 accepts a "V"-shaped spring 126, preferably made of steel, that contains a loop at the closed-end of the "V". The loop is sized to correspond to the size of hole 128 in the adjustment screw head 127, about ⅛ inch in diameter. Spring 126 slides into slot 129 so the spring loop and hole 128 correspond.

The clamping mechanism of the mounting bracket 100 is provided by two support clips 130 and 135. Support clips 130 and 135 are "T"-shaped; the vertical component is about ¾ inch long, and the horizontal component, or jaws 133 and 141 respectively, are about 2 inches long. FIGS. 1 and 2 illustrate the relationship of the curvilinear shape of the vertical component and the channel-shape of jaws 133 and 141. Support clips 130 and 135 are preferably constructed from stainless steel and finished with a hard enamel. The enamel finish helps prevent the support clips 130 and 135 and the jaws 133 and 141 from scratching or gouging the support structure, on which the mounting bracket 100 clamps. Positioned about ⅜ inch from the bottom of support clips 130 and 135 is the center line of the holes on the pair of ears 131, 131A and 137, 137A integrally formed on each support clip 130 and 135 respectively. Ears 131, 131A, 137, and 137A extend inwardly at right angles from either side of the vertical component of support clips 130 and 135 as shown in FIG. 1.

Figure 2A:
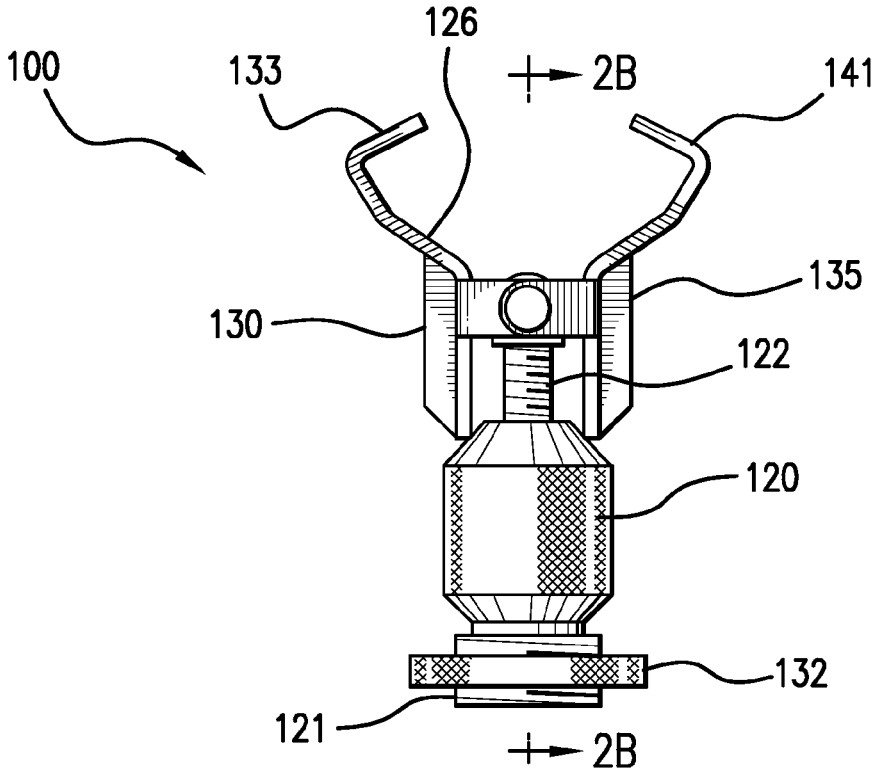
FIG. 2A is an elevation view of an assembled mounting bracket of this invention.

After spring 126 is installed in slot 129, holes of ears 131 and 131A on support clip 130 are placed in a corresponding relationship with hole 128. Next, holes of ears 137 and 137A on support clip 135 are placed in corresponding relationship with the holes of ears 131 and 131A as shown in FIGS. 1 and 2. Support clips 130 and 135 and spring 126 are properly installed in relation to the adjustment screw 122 when the spring 126 engages and exerts tension against the vertical components of both support clips 130 and 135 as shown in FIG. 2A. After support clips 130 and 135, spring 126 and adjustment screw head 127 are aligned, a set pin 124 slides into the aligned holes to securely integrate the components. The set pin 124 is about 0.120 inch in diameter, about 0.005 inches smaller than the diameter of the holes. The 0.005 inch difference in dimensions between the holes and set pin 124 exist to allow for a snug fit without "slop." The clearance still allows for smooth rotation of support clips 130 and 135 about adjustment screw head 127 and set pin 124. After set pin 124 is installed, both ends of pin 124 are compressed to cause the surface area of the ends to increase and prevent pin 124 from sliding out of hole 128.

An adjustment nut 132, about ⅝ inch in diameter with an internal 27 UNC thread screws over the threaded end 121 of body 120. The adjustment nut locks the microphone holder in place. A protective cap (not shown) which slides over the threaded end may, if desired, be used to protect the threads of the threaded end 121 when the mounting bracket 100 is not in use.

Figure 2B:
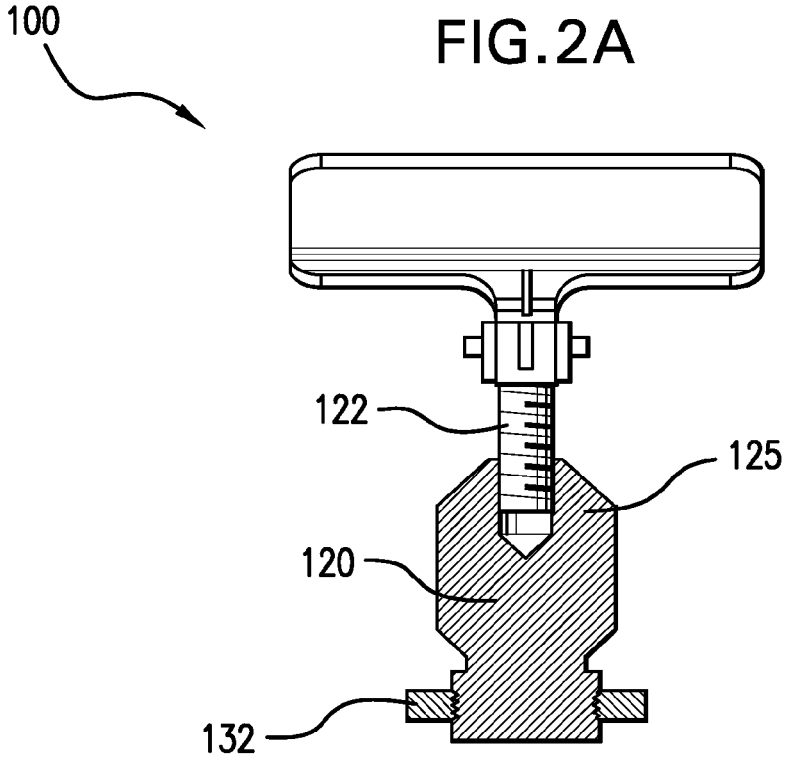
FIG. 2B is a sectional view of the mounting bracket of FIG. 2A.

FIG. 2A and FIG. 2B illustrate the mounting bracket 100 properly assembled. In the full-open state, the bottom ends of support clips 130 and 135 are positioned on the uppermost position of tapered end 123. Adjustment screw 122 is extended from body 120; spring 126 biases open support clips 130 and 135; and jaws 133 and 141 are at their furthest distance from each other. This distance is about one inch. The mounting bracket 100 may clamp to almost any object that is less than about 1½ inch in diameter or width.

If body 120 rotates from left to right and support clips 130 and 135 and adjustment screw 122 are held stationary, the adjustment screw 122 retracts into circular body 120 causing the ends of support clips 130 and 135 to slide down tapered end 123. As the ends of support clips 130 and 135 slide down the tapered end 123, the support clips 130 and 135 rotate about set pin 124, causing jaws 133 and 141 to come together. When adjustment screw 122 travels to its limit within body 120, the bottom ends of support clips 130 and 135 slide down to the end of tapered end 123, and jaws 133 and 141 engage each other and mounting bracket 100 is in the closed position.

To open jaws 133 and 141, body 120 is caused to rotate from right to left while support clips 130 and 135 and adjustment screw 122 are held stationary. The adjustment screw 122 extends from body 120, and the ends of support clips 130 and 135 travel up tapered end 123 causing support clips 130 and 135 to rotate about set pin 124 forcing jaws 133 and 141 to open. In every position, other than closed, spring 126 biases support clips 130 and 135 open. Without spring 126, there would not be any forces to maintain support clips 130 and 135 open, and jaws 133 and 141 would close upon each other in a haphazard manner. Spring 126 prevents jaws 133 and 141 from flopping closed while the user maneuvers mounting bracket 100 about the support structure.

An alternate embodiment, the heavy-duty embodiment of the mounting bracket, provides a mounting bracket enabled to clamp onto an object that is about two inches in diameter or width and also to support heavier loads than the light-duty embodiment. The heavy-duty embodiment of the mounting bracket can support maximum weight of 22 pounds. In this embodiment, body 120 is approximately 1¼ inches long and, at its widest point, one inch in diameter. Body 120 is preferably constructed from aluminum, although alternative material such as stainless steel may be used. In the heavy-duty embodiment, about ¼ inch from its top, circular body 120 tapers inward at about a 34-degree angle until the diameter at the top of tapered end 123 is about ¼ inch. The top of the tapered end 123 is centered about the diameter of body 120. At the top of tapered end 123, a hole 125, about ⅞ inch long and capable to accept a #¼-20 thread is drilled and tapped into body 120. Tapered end 123 is finished smooth to allow the ends of support clips 130 and 135 to slide up and down tapered end 123. Circular body 120 is knurled from below the tapered end 123 for about ½ inch. The knurled area allows an individual to firmly grasp and rotate body 120 to open or close support clips 130 and 135. Below the knurled area, body 120 tapers inward until the diameter of body 120 is about ⅝ inch. The remaining ⅜ inch of body 120 comprises threaded end 121. Threaded end 121 is an external 27 UNF thread. Threaded end 121 receives a corresponding internally 27 UNF threaded end of a standard microphone holder.

Adjustment screw 122 can be made with various dimensions and thread configurations to accommodate a variety of applications, such as light-duty, medium-duty, and heavy-duty, as an example.

Figure 4:
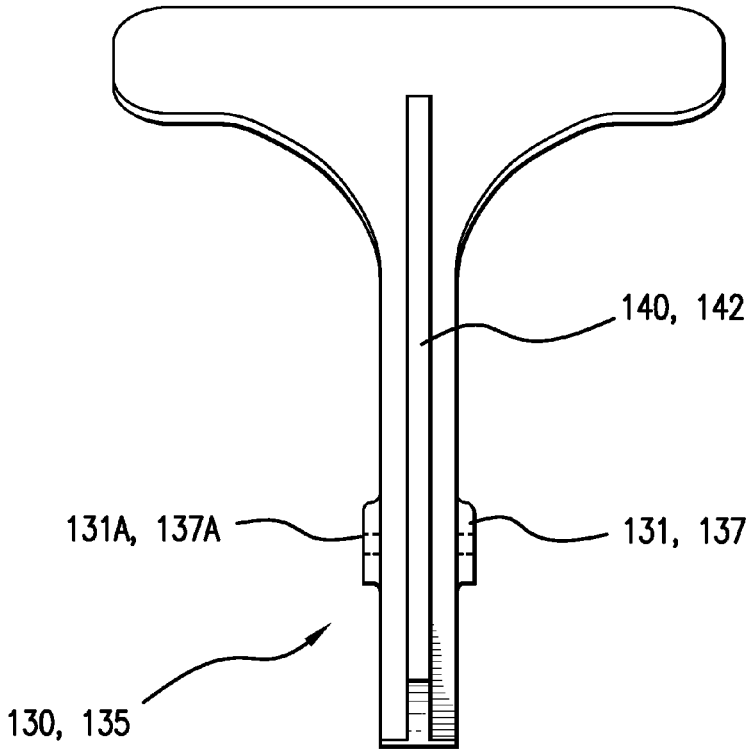
FIG. 4 is an exaggerated plan view showing a support clip of this invention.

The clamping mechanism of mounting bracket 100 is provided by two support clips 130 and 135 as shown in FIG. 4. For the heavy-duty embodiment, support clips 130 and 135 are "T"-shaped; the vertical component is about 2 inches long and the horizontal component, or jaws 133 and 141, is about 2 inches long. A supporting gusset 140 and 142 is attached to support clips 130 and 135. Gussets 140 and 142 add stability to support clips 130 and 135 to enable this embodiment of mounting bracket 100 to support more weight than the light-duty embodiment. Support clips 130 and 135 are constructed from stainless steel and finished with a hard enamel. The enamel finish helps prevent support clips 130 and 135 and jaws 133 and 141 from scratching or gouging the support structure (not shown) on which mounting bracket 100 clamps.

Positioned about ¾ inch from the bottom of support clips 130 and 135 is the center line of the holes on the pair of ears 131, 131A, and 137, 137A integrally formed on each support clip 130 and 135 respectively. Ears 131, 131A and 137, 137A extend inwardly at right angles from either side of the vertical component of support clips 130 and 135 as shown in FIG. 4. After spring 126 is installed in slot 129, holes of ears 131 and 131A are placed in a corresponding relationship with hole 128. Next, holes of ears 137 and 137A are placed in corresponding relationship with the holes of ears 131 and 131A in a similar fashion as in the light-duty embodiment. Support clips 130 and 135 and spring 126 are properly installed in relation to the adjustment screw 122 when the spring 126 engages and exerts tension against the vertical components of both support clips 130 and 135. After support clips 130 and 135, spring 126 and adjustment screw head 127 are aligned, a set pin 124 slides into the aligned holes to securely integrate the components. The set pin 124 is about 0.120 inch in diameter, about 0.005 inch smaller than the diameter of the holes. The 0.005 inch difference in dimensions between the holes and set pin 124 exist to allow for a snug fit without "slop." The clearance allows for smooth rotation of the support clips 130 about adjustment screw head 127 and set pin 124. After set pin 124 is installed, both ends of pin 124 are compressed to cause the surface area of the ends to increase and prevent pin 124 from sliding out of hole 128.

A nylon protective cap (not shown) of ⅝ inch in diameter slides over threaded end 121 of body 120. The protective cap protects the threads of the threaded end 121 when the mounting bracket 100 is not in use.

Figure 5A:
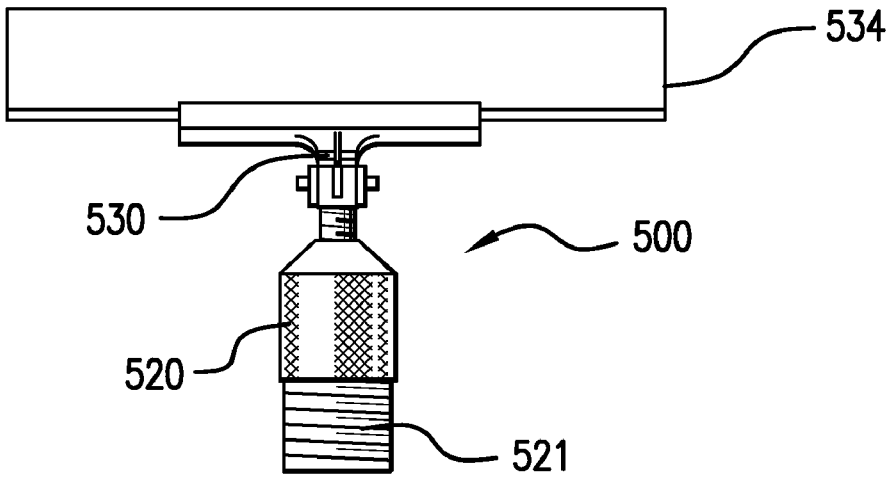
FIGS. 5A and 5B show elevation view of the mounting bracket clamped to a cross beam or support structure.
Figure 5B:
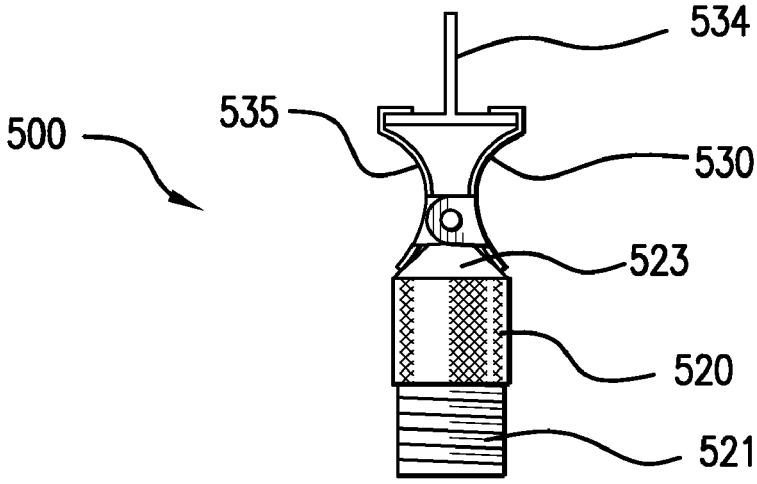

FIGS. 5A and 5B illustrate two views of mounting bracket 500 clamped to a support structure 534. The figures illustrate an inverted "T" support structure, such as the framework for a drop ceiling, only for demonstration purposes. The mounting bracket has the capability of attaching to uniform or non uniform objects such as trees, poles, drop ceilings, pipes, doors, handles and knobs, just to name a few. The main difference between this embodiment, and that shown in FIG. 1, is the shape of the support clips 530 and 535. The other referenced components, body 520, tapered end 523, and threaded end 521 function in a similar manner to the embodiment of FIG. 1. Threaded end 521 of circular body 520 is threaded to accept the standard 27 UNF thread of a conventional microphone holder used in the sound recording trade.

Figure 6:
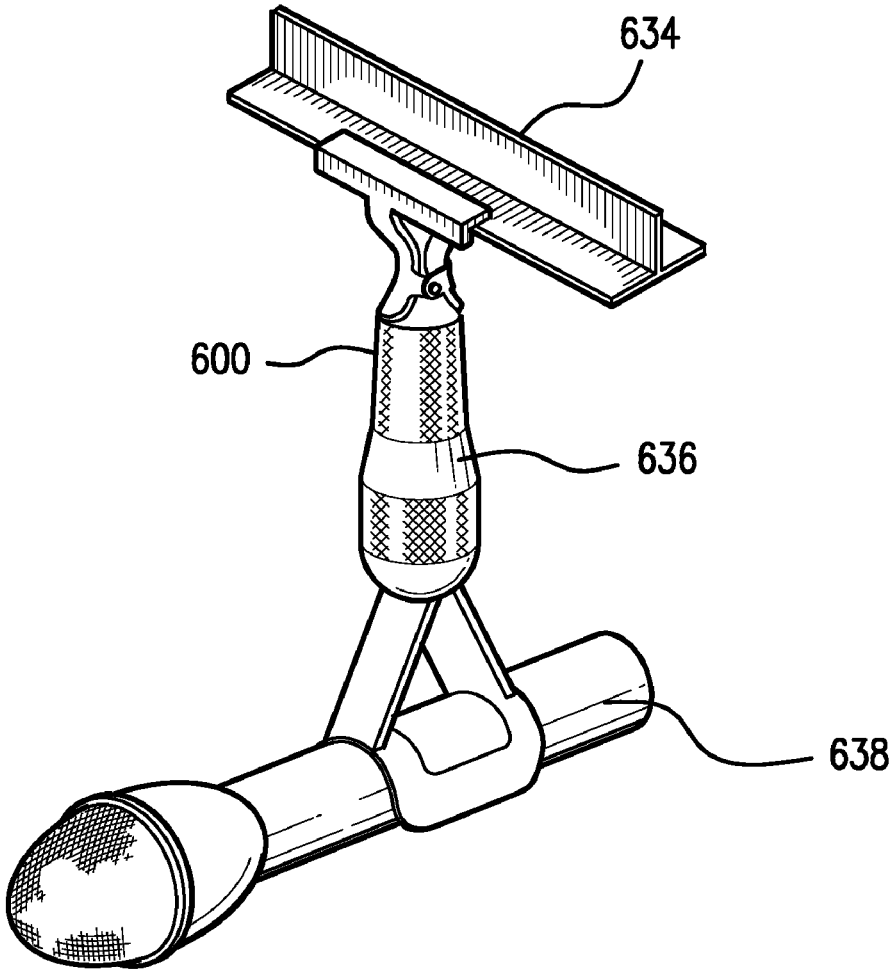
FIG. 6 is an isometric view of the mounting bracket attached to a microphone holder and a microphone.
Figure 7A:
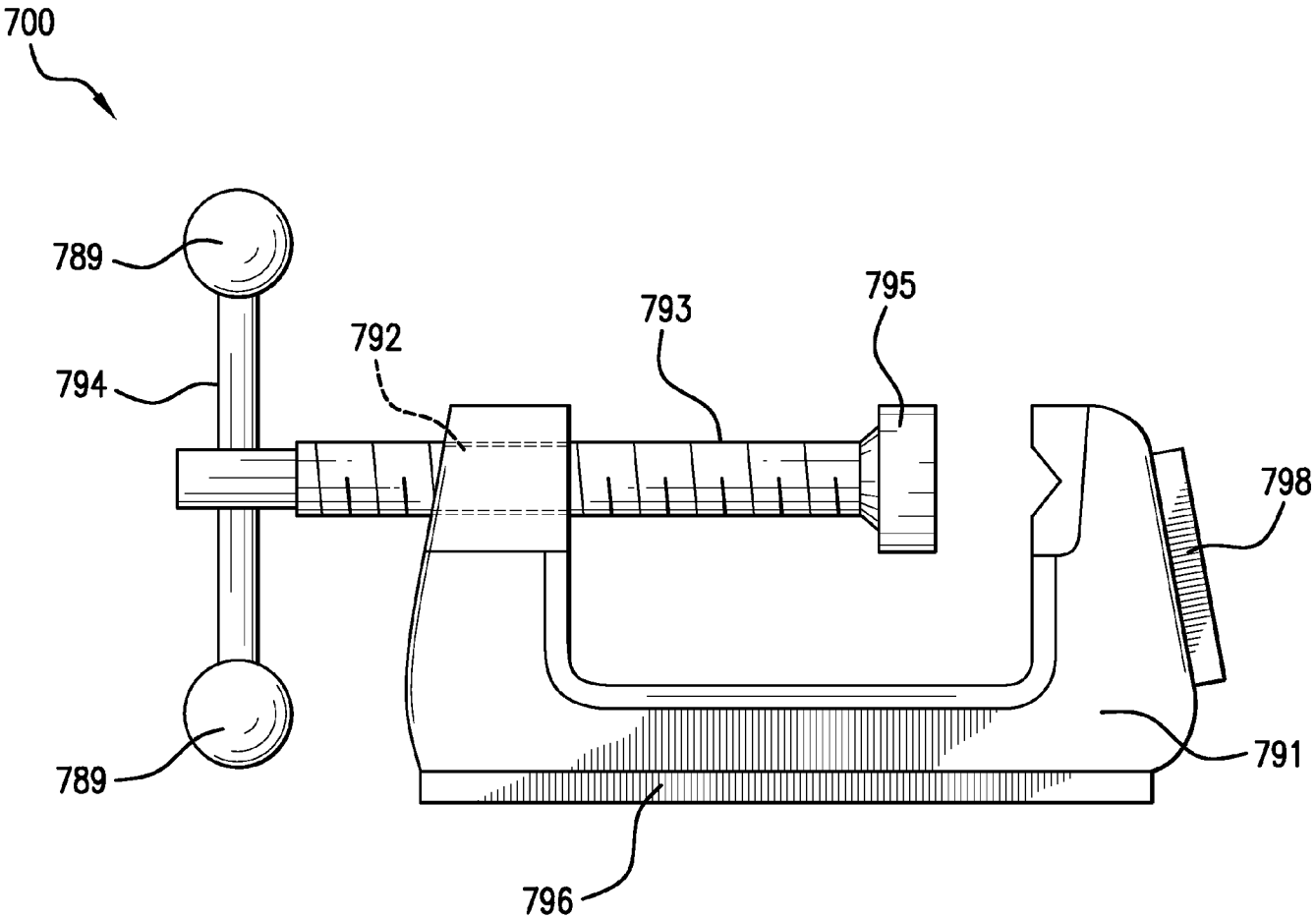
FIG. 7A is a front view of a modified C-clamp with the mounting bracket.
Figure 7B:
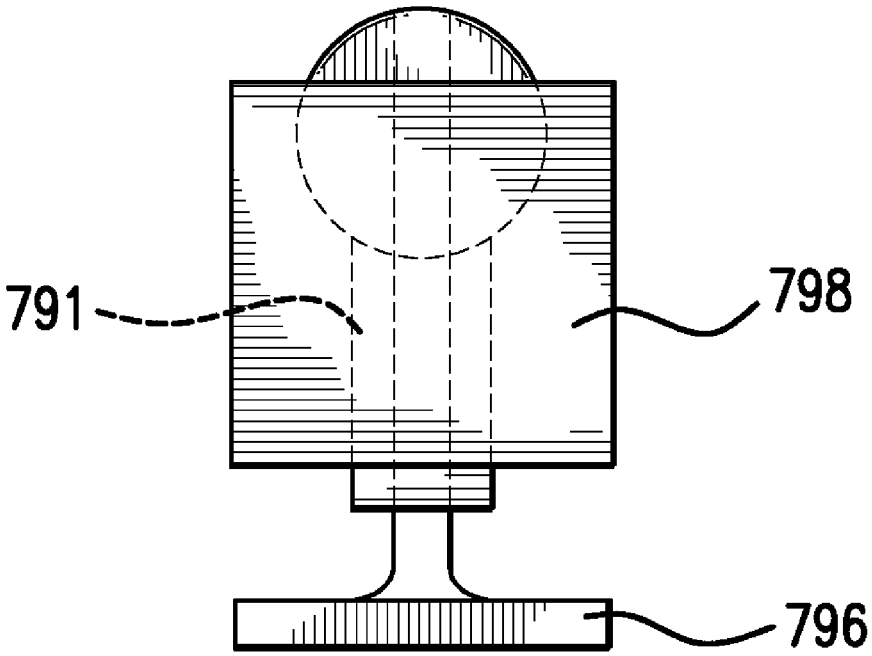
FIG. 7B is a side view of a modified C-clamp with the mounting bracket.

FIG. 6 illustrates use of the mounting bracket shown in FIGS. 5A and 5B, here indicated as 600 clamped to a support structure 634 and attached to a microphone holder 636. Slidably attached to the microphone holder is a microphone 638.

FIGS. 7 through 16 illustrate the accessories that when combined in a kit, make the mounting bracket even more versatile. FIGS. 7A and 7B illustrate a mounting bracket with a custom designed C-clamp, 700.

The custom designed C-clamp 700 comprises a C-shaped frame 791 having an elongated segment and two short segments, with a threaded hole 792 in the first short segment, a threaded rod 793 with steel handle 794 on one end and flat base 795 on the other end, a steel base plate 796 on the outer side of the elongated segment of the C-shaped frame 791, and a steel side plate 798 on the outer side of the second short segment of the C-shaped frame 791 which is opposite the threaded hole 792. The steel handle 794 has ball knobs 789 at the two ends. The steel base 796 is 0.13" thick, 3.13" long, and 1" wide. The steel side plate 798 is 1" square and 0.13" thick. The C-clamp 700 can be mounted on any surface by tightening the threaded rod 794 until the flat base 795 exerts sufficient pressure the surface of the object to be clamped to secure it in place. The mounting bracket 100 can be clamped onto the C-clamp 700 either by clamping onto the base plate 796 or onto the side plate 798 by the clamping procedure described hereinabove.

Figure 8A:
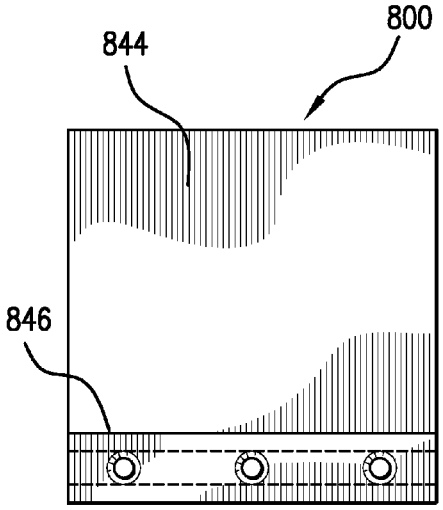
FIG. 8A is a plan view of an accessory plate assembly with tee attachment.
Figure 8B:
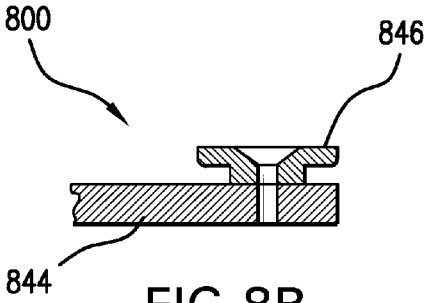
FIG. 8B is a partial cut-away elevation of the embodiment of FIG. 8.

FIGS. 8 and 9 represent two embodiments of desk stand plate assemblies 800 and 900 that can be used in conjunction with the mounting bracket 100.

In FIG. 8A, desk stand plate assembly 800 comprises a plate 844 and "T" element 846. Plate 844 is about 5¼ inch square by ¼ inch thick. The "T" element 846 corresponds in length to the plate 844 and is about ¼ inch high and about ½ inch wide at its base and 1 inch wide at its top and mounts flush with one end of the plate 844. The "T" 846 attaches to the plate 844 by countersinking three #10-32×⅜ inch UNF flat head screws. Plate 844 and "T" element 846 are preferably constructed of plastic, but can be alternatively fabricated from various other materials such as aluminum or steel.

Figure 9A:
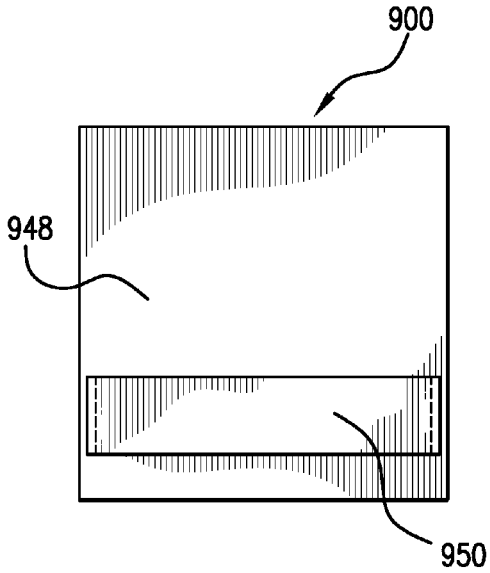
FIG. 9A is a plan view of an alternate embodiment of an accessory plate assembly with channel attachment.
Figure 9B:
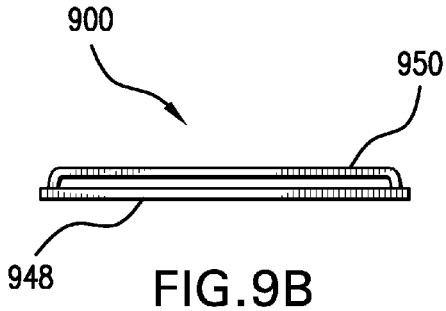
FIG. 9B is an elevation of the embodiment of FIG. 9A.

In FIGS. 9A and 9B, desk stand plate assembly 900 comprises a steel plate 948 and a steel "U" element 950. Plate 948 is about 5½ inch square by ⅛ inch thick. The "U" element 950 is about ¼ inch shorter in length than the plate 98 and is about 1 inch wide by ¼ inch high. The "U" element 950 mounts in an inverted position on the plate so one long side is about ⅝ inches from one end of the plate 948 and the ends of the "U" 950 are about ¼ inch from the side of the plate 948. The "U" 950 attaches to the plate 948 by tack welding along an interface between the end of the "U" 950 and the top of plate 948. The desk stand plate assembly 900 may be painted to give it a finished look.

Plate assemblies 800 and 900 can be used in conjunction with mounting bracket 100 if only a flat mounting surface such as a table or podium is available. For example, a speaker or singer may be positioned behind a table or podium and no other surfaces are convenient to attach mounting bracket 100 to position a microphone. In this situation, plate assemblies 800 and 900 rest on the flat surface. The plate assemblies (800 or 900) provide a support structure suitable to support mounting bracket 100. In the case of plate assembly 800 or 900, the mounting bracket 100 clamps to the "tee" 846 or "U" 950 respectively. The microphone holder then threads onto mounting bracket 100 and a microphone may be positioned accordingly to record or amplify the voice of the speaker or singer. Plate assemblies 800 and 900 are designed to accept multiple mounting brackets 100 so microphones from various individuals or organizations may be neatly positioned in front of the speaker or singer.

Figure 10C:
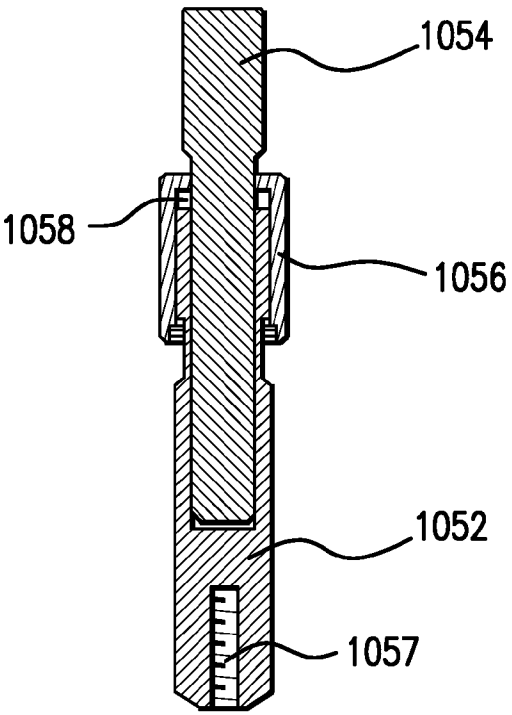
FIG. 10C is a sectional view of the stand assembly of FIG. 10B.
Figure 10B:
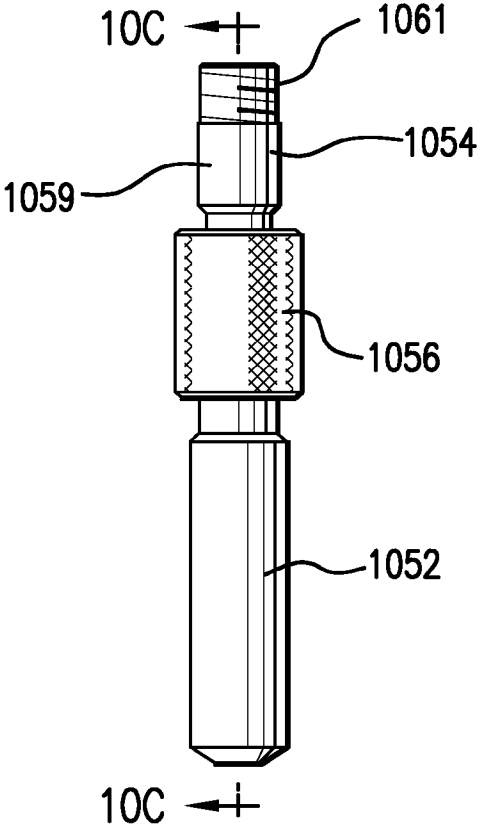
FIG. 10B is a plan view of the stand assembly of FIG. 10A.
Figure 10A:
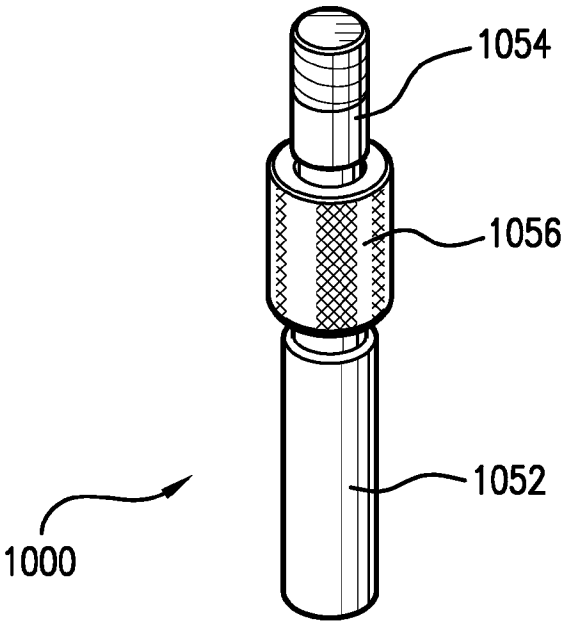
FIG. 10A is a perspective view of a stand assembly.
Figure 11A:
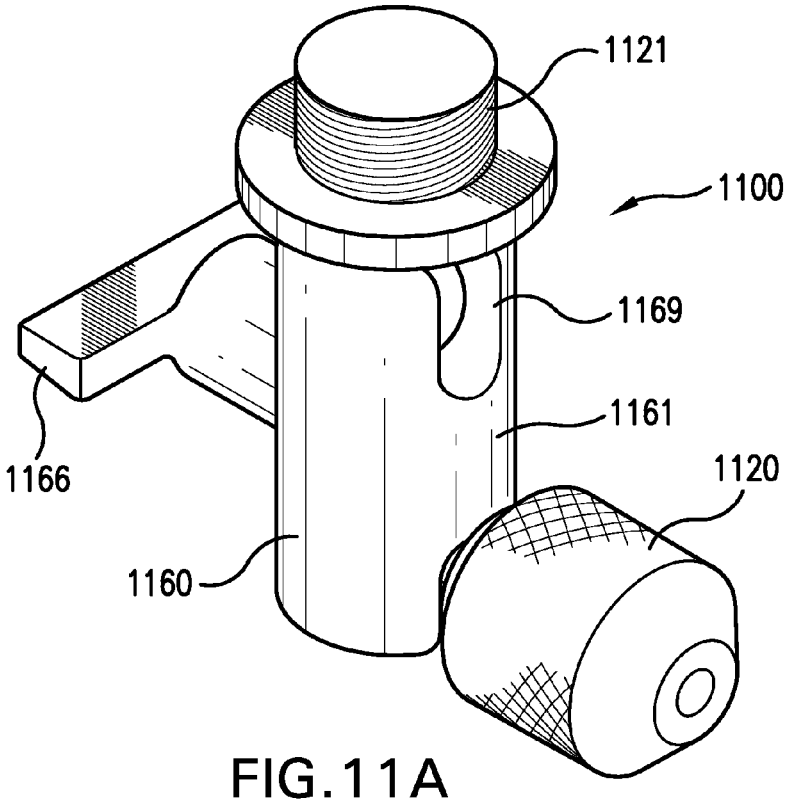
FIG. 11A is a perspective view of a universal assembly.
Figure 11B:
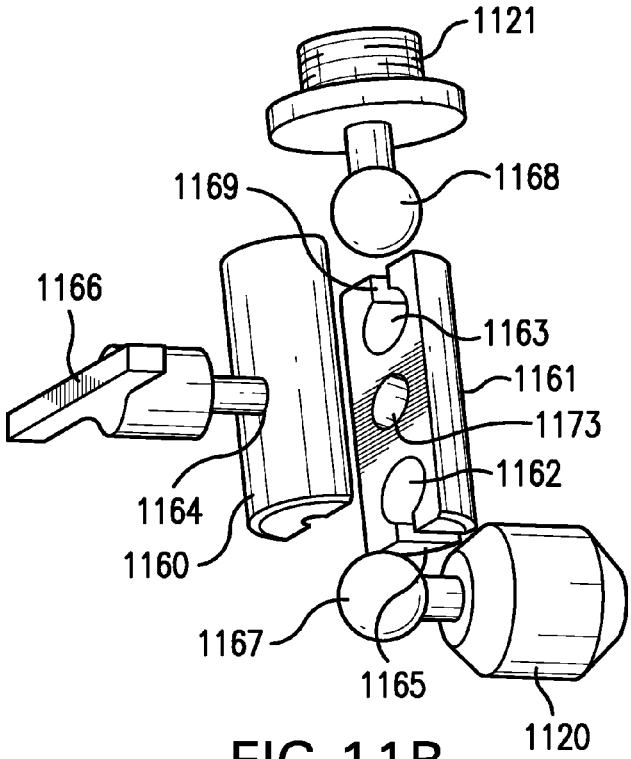
FIG. 11B is an exploded view of the universal assembly of FIG. 11A.
Figure 11D:
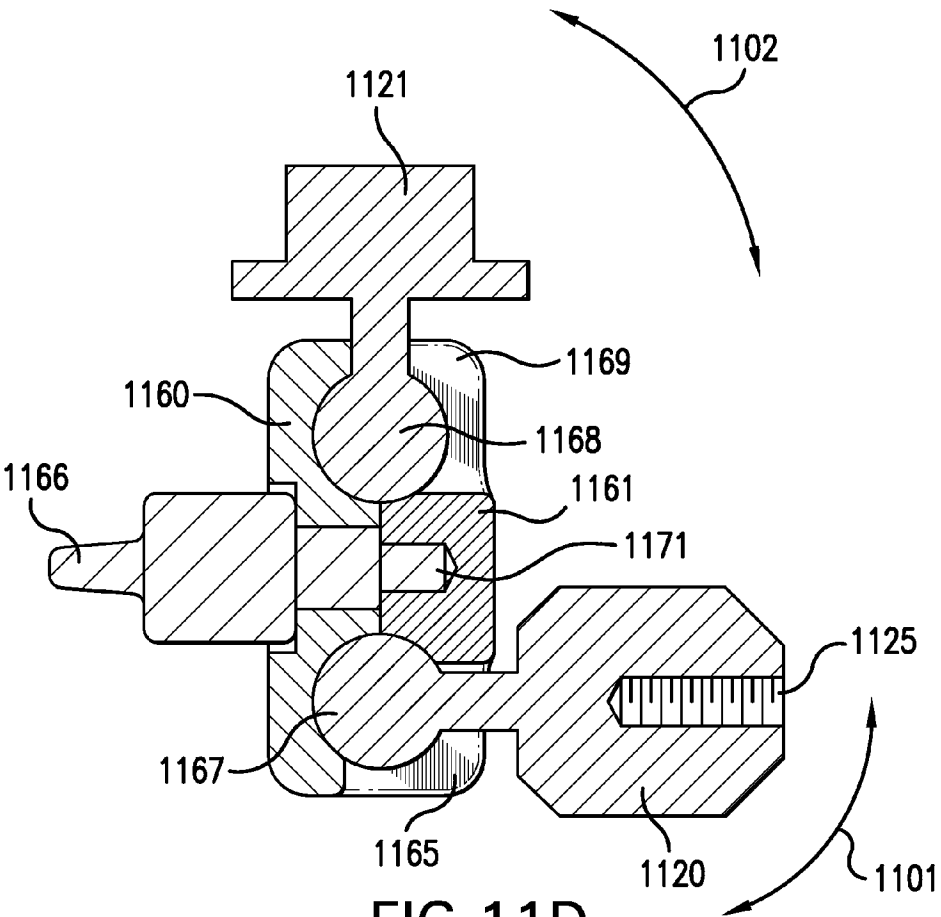
FIG. 11D is a sectional view of the universal assembly shown in FIG. 11C.
Figure 11C:
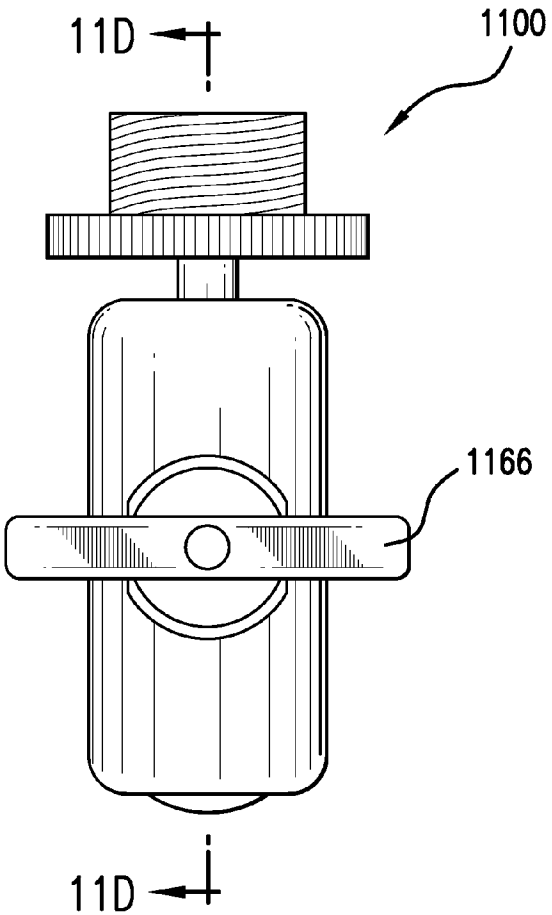
FIG. 11C is a plan view of the universal assembly of FIG. 11A.
Figure 12A:
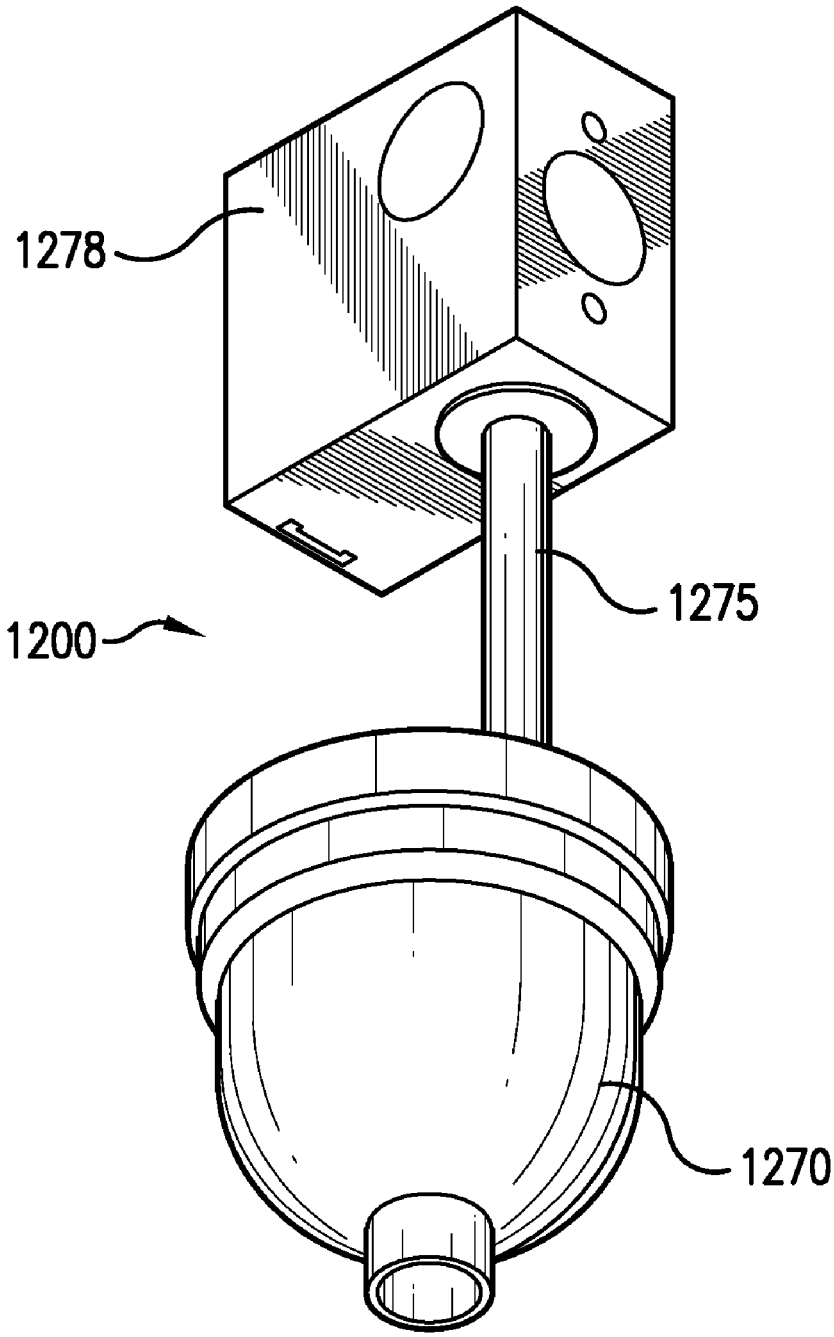
FIG. 12A is a perspective view of a drop ceiling light assembly.
Figure 12B:
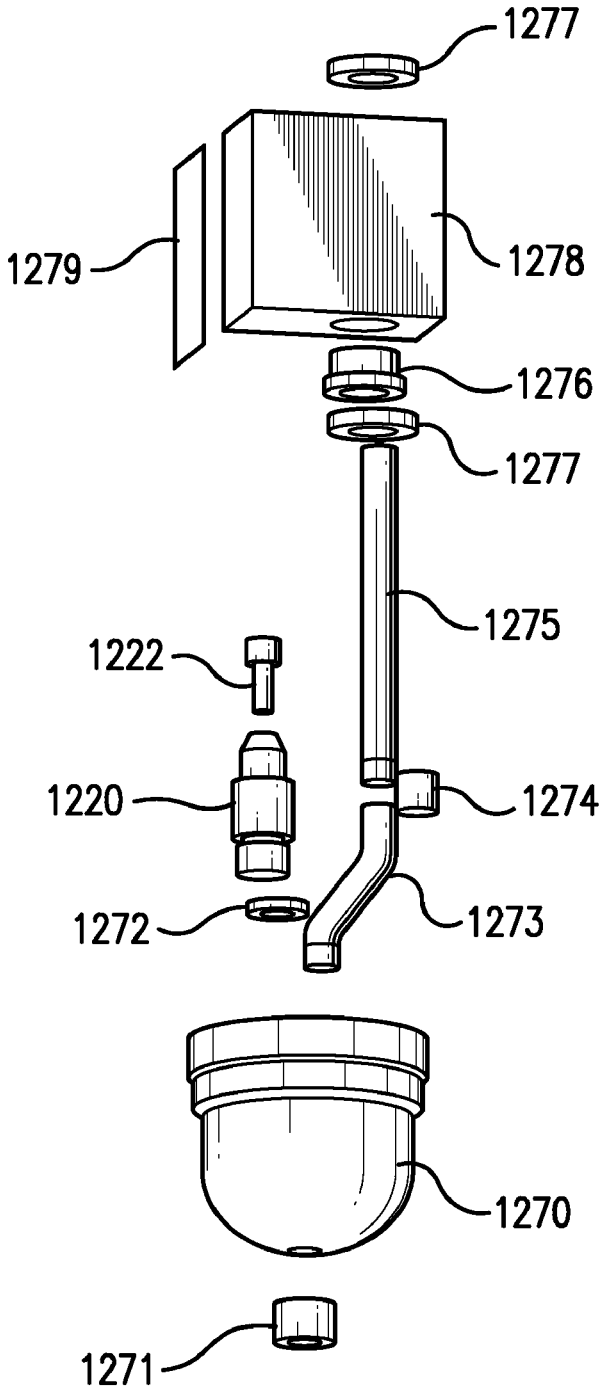
FIG. 12B is an exploded view of the drop ceiling light assembly of FIG. 12A.
Figure 12C:
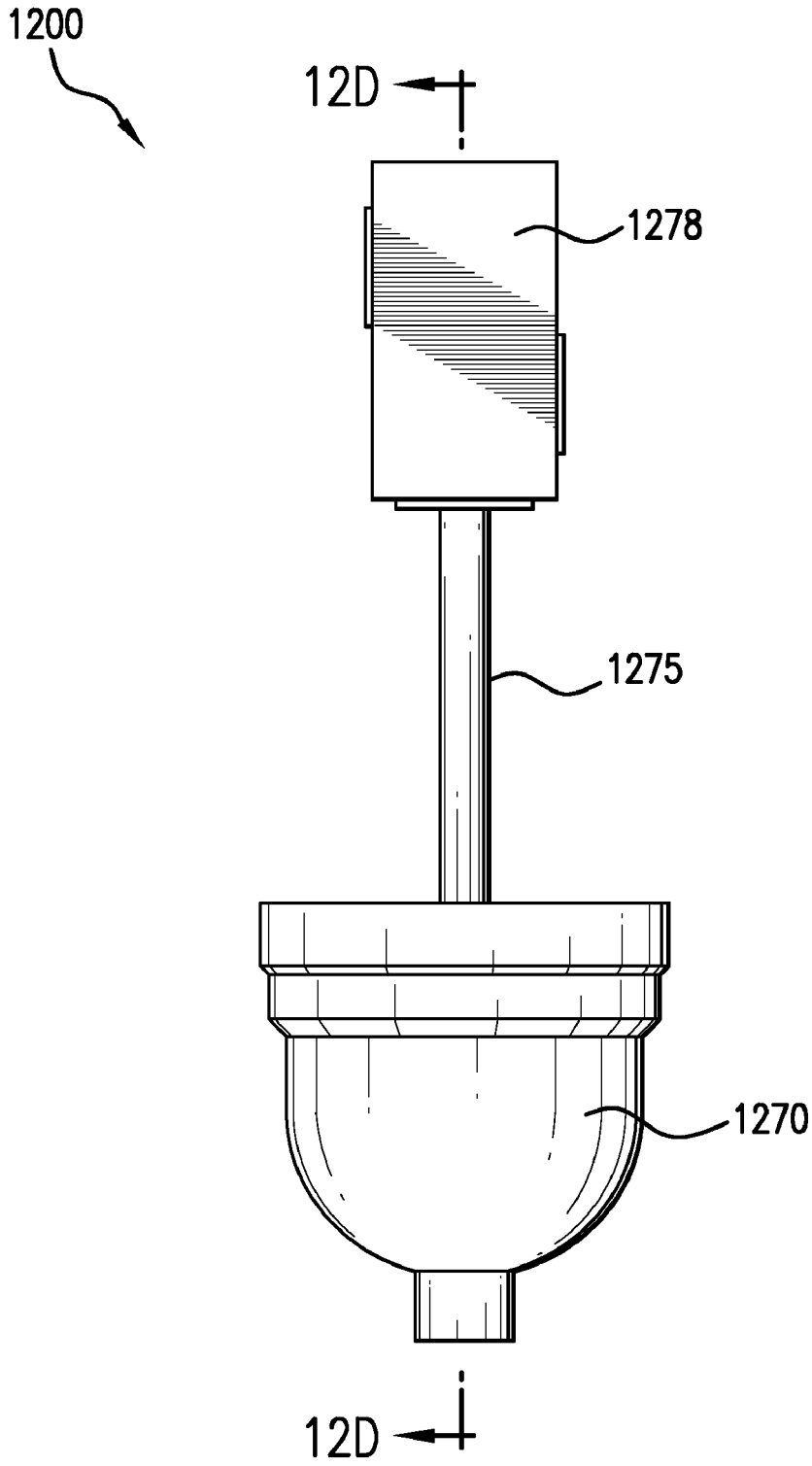
FIG. 12C is a plan view of the drop ceiling light assembly of FIG. 12A.
Figure 12D:
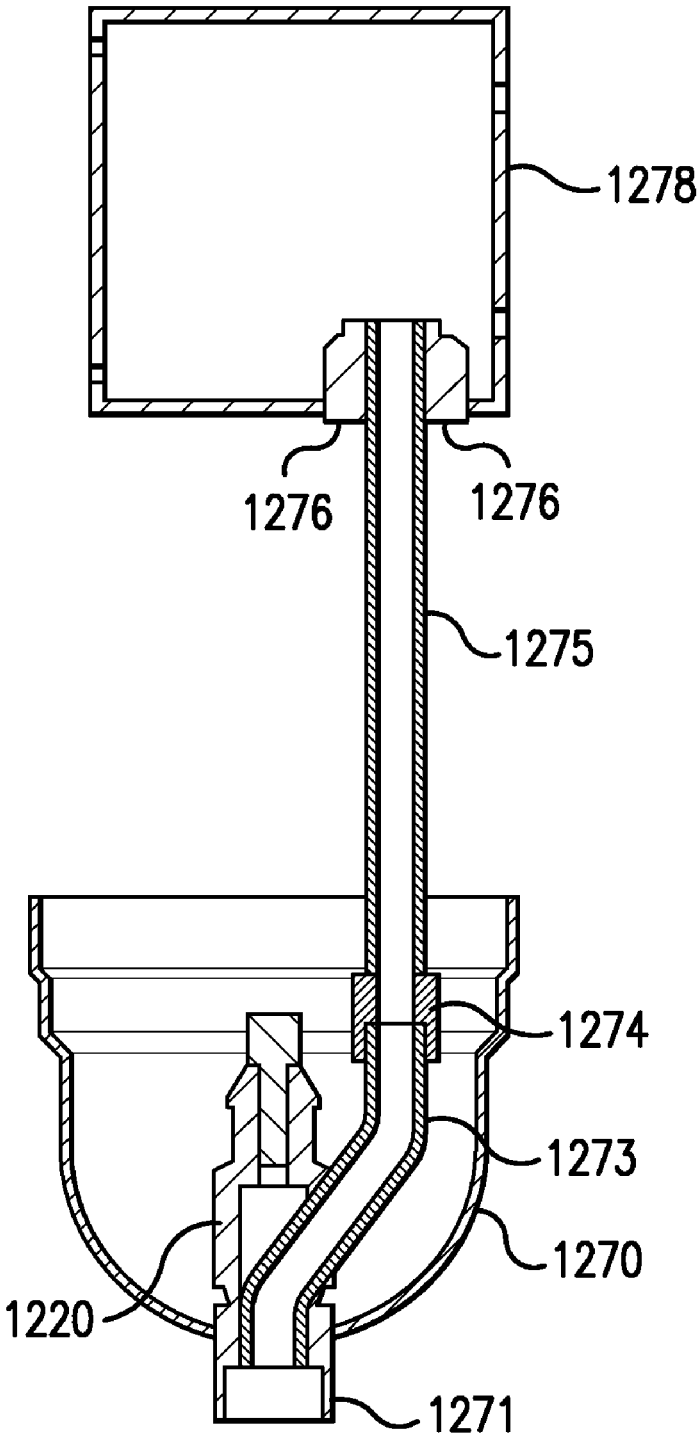
FIG. 12D is a sectional view of the drop ceiling light assembly shown in FIG. 12C.

FIGS. 10A, 10B, and 10C illustrate stand assembly 1000. The stand assembly comprises bottom shaft 1052, top shaft 1054, sleeve 1056, and bushing 1058. One end of the bottom shaft 1052 has a hole 1057 with internal 10-32 UNF threads to attach an adjustment screw 122 and hence the support clips 130, 135. The other end of the bottom shaft 1052 has the threaded end with ¾-16 threads on which the sleeve 1056 is fastened on. The outer diameter of the bottom shaft 1052, top shaft 1054, and the sleeve 1056 are about ¾ inch, 0.61 inch, and 1 inch respectively. The top shaft 1054 has one smooth end 1059 which slides into the bottom shaft and a threaded end 1061 with external ⅝-27 UNF to receive a corresponding internally 27 UNF threaded end of a microphone holder.

Stand assembly 1000 can be used in conjunction with the desk stand plate assemblies 800, 900. First, the bottom shaft is secured to either the "T" element 846 of the desk plate assembly 800 or the "U" element 950 of the desk plate assembly 900 using the adjustment screw 122, pin 124, spring 126 and two support clips 130, 135. Once the bottom shaft 1052 is secured to the desk stand plate assembly 800, 900, a bushing 1058 is slid onto the top shaft 1054 followed by sleeve 1056. After adjusting the desired height required for microphone, the sleeve 1056 is fastened onto the bottom shaft 1052 by engaging its internal threads with the external threaded end of the bottom shaft 1052. The top shaft 1054 is thereby attached to the bottom shaft 1052 via the sleeve 1056. Conventional microphone holder is then attached to the threaded end 1061 of the top shaft by the standard 27 UNF thread.

FIGS. 11A, 11B, 11C and 11D illustrate various views of an adjustable mounting bracket, referred to as the universal assembly 1100. The universal assembly 1100 comprises a circular body 1120 with ball-shaped fixture (generally referred to as "ball end") 1167, a microphone adapter or threaded end 1121 with ball end 1168, and a cylindrical block with two notches, each notch being adapted for receiving a ball end. This cylindrical block is referred to as a universal block and comprises two separable parts 1160 and 1161 and two spherical sockets 1162 and 1163, and a bar knob 1166 with threaded end used to hold the two parts of the universal block 1160 and 1161 together. The ball and socket joints of the universal assembly provide 360 degrees of rotational freedom. The universal assembly also provides 90 degrees of tilt to both the circular body 1120 and the threaded end 1121 via the slits 1165 and 1169 with respect to the universal block.

Assembly of the universal block is easy, following the steps of first placing the ball end 1167 of the circular body 1120 in the socket 1162 and ball end 1168 of the threaded end 1121 in the socket 1163, followed by securing the two pieces 1160 and 1161 of the universal block with the bar knob 1166. Bar knob 1166 is attached to threaded screw 1171. Threaded screw 1171 engages with threaded hole 1173 in universal block part 1161. The orientation of the circular body 1120 and threaded end 1121 can be adjusted before tightening the bar knob. The two support clamps 130, 135 can now be attached to the circular body 1120 using the adjustment screw 122, pin 124 and "V" spring 126 as described above. The threaded end 1121 of the universal assembly 1100 can be attached to the conventional microphone holder via ⅝-27 UNF thread.

FIGS. 12A, 12B, 12C, and 12D illustrate various views of the drop ceiling light assembly 1200. The purpose of drop ceiling light assembly 1200 is to provide an anchoring point for a mounting bracket 100, that holds a light (not shown) which is receives electricity from wires (not shown) originating from electric box 1278. The drop ceiling light assembly comprises a light cover 1270, nut 1271, thin nut 1272, curved shaft 1273, sleeve cover 1274 for connecting curved shaft 1273 with linear shaft extension 1275, shaft nut 1276, another thin nut 1277, an electric box 1278, an electric box cover 1279, a modified mounting bracket 1220, and an adjustment screw 1222.

Assembly of the drop ceiling light assembly requires inserting the curved shaft 1273 into the modified mounting bracket 1220, securing the mounting bracket to the light cover 1270 using the nut 1271 and thin nut 1271, attaching the extension shaft 1275 to the curved shaft 1273 by sleeve cover 1274, and finally securing the extension shaft 1275 to the electric box 1278 by shaft nut 1276 and thin nut 1277. The support clips 130 and 135 can be attached to the modified mounting bracket using the adjustment screw 1222, pin 124, and spring 126. The light cover 1270 hides the light, wires and mounting bracket from view when mounted on a ceiling. This embodiment provides for quick installation of multiple ceiling-mounted lights. For example, in a restaurant, it is feasible to use this embodiment to install a light above each table in the restaurant quickly and efficiently. Note that while the light cover 1270 illustrated is "dome shaped", those skilled in the art will recognize that other shapes are possible, such as a substantially flat shape or a cubic shape, without departing from the spirit of the present invention.

Figure 13:
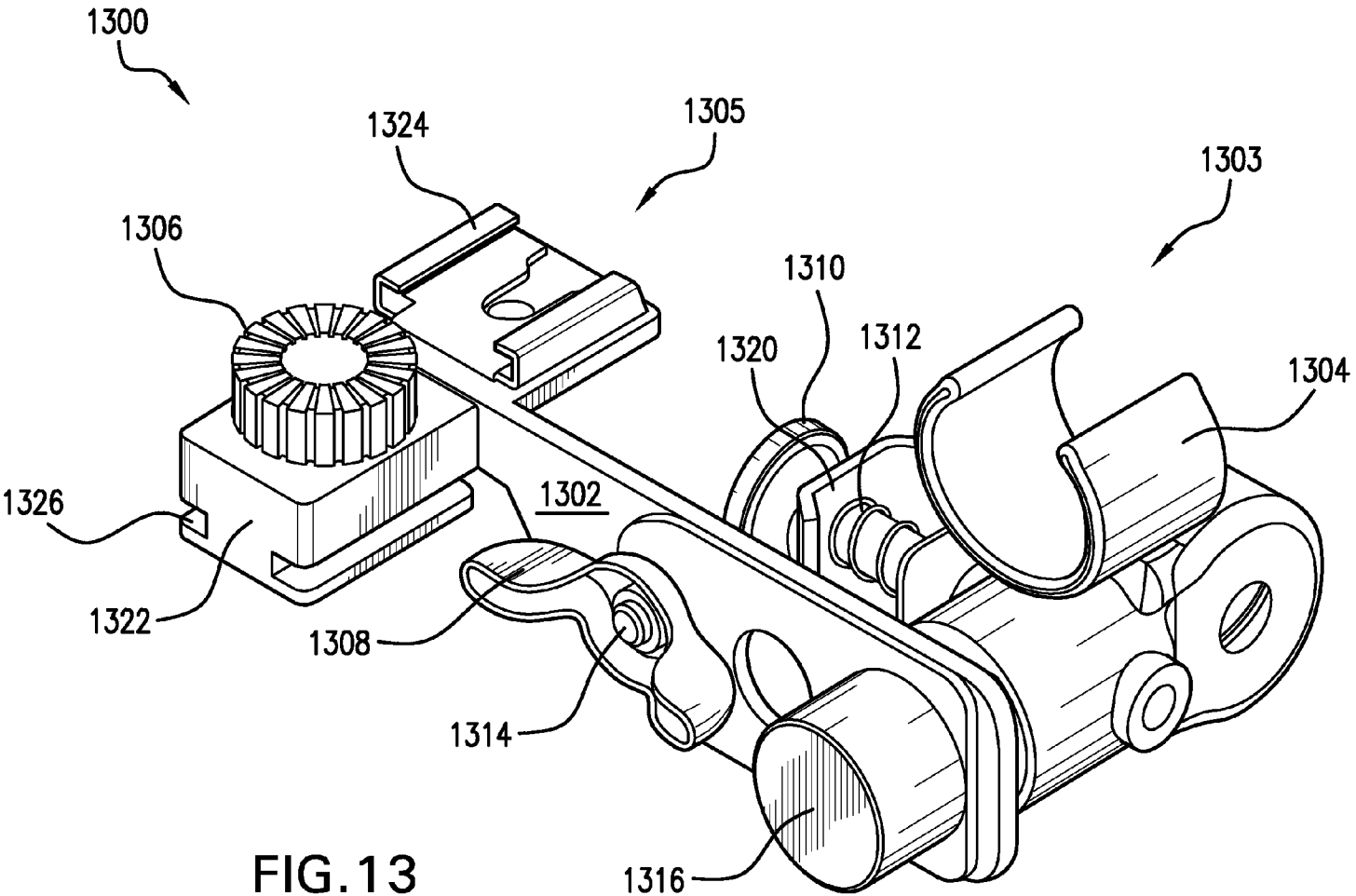
FIG. 13 is a perspective view of a shoe mount adapter.

FIG. 13 illustrates a shoe mount adapter 1300 that provides for attaching both a light source and a microphone to a camera. Shoe mount adapter 1300 comprises plate 1302. Attached to the plate is microphone holder subassembly 1303 and shoe mount subassembly 1305. Microphone subassembly holder 1303 is comprised of a microphone holder 1304, which is fastened to plate 1302 via locknut 1316. A means for securing a microphone cable is provided via cable holder 1320, which is held in place at a desired position via locknut 1310. Tension spring 1312 holds cable holder 1320 open to the extent allowed by locknut 1310, such that a microphone cable may be held by cable holder 1320. The microphone holder subassembly 1303 is additionally held in place by wing nut 1308, which is fastened onto threaded screw 1314. Threaded screw 1314 extends outward from plate 1302.

Shoe mount subassembly is comprised of shoe mount guide 1322. Shoe mount guide 1322 has two grooves, indicated generally as 1326. Grooves 1326 engage with the standard shoe mount found on many types of cameras. Shoe mount guide 1322 is fastened to plate 1302 via shoe mount locknut 1306. Shoe mount 1324 is attached to the opposite side of plate 1302 as the shoe mount guide 1322.

To use the shoe mount adapter 1300, shoe mount guide 1322 slides into the standard shoe mount of a camera (not shown). A light may then be placed in shoe mount 1324, and a microphone may be placed in microphone holder 1304, thereby providing a convenient way to attach both a light source, and an external microphone to a camera.

Figure 13A:
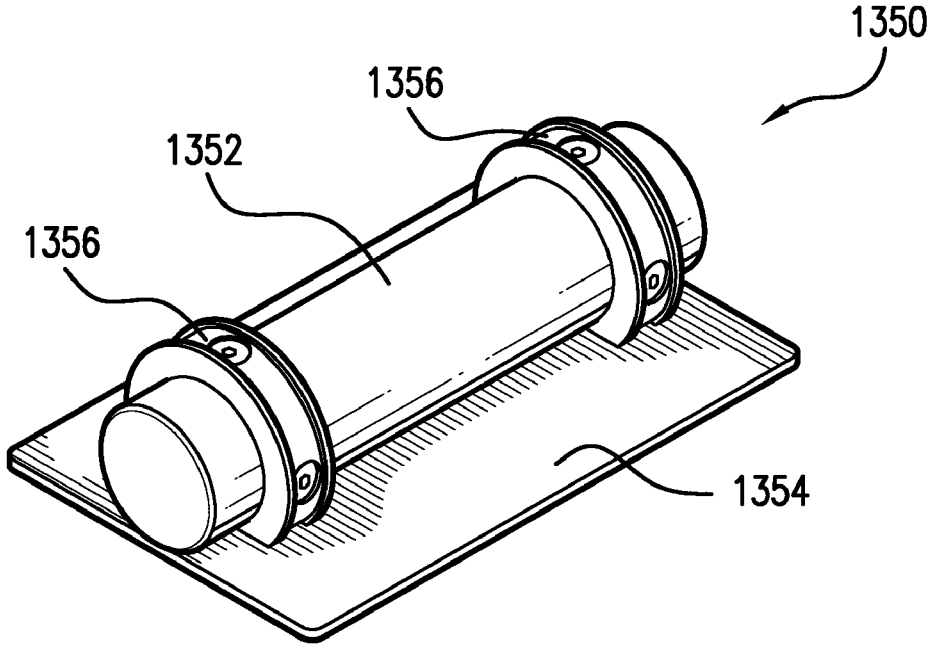
FIG. 13A is a perspective view of a wireless microphone adapter.
Figure 13B:
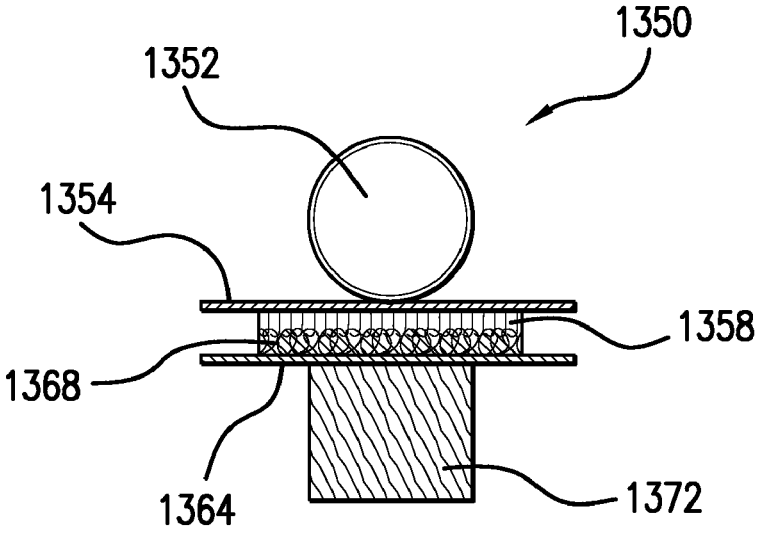
FIG. 13B is a side elevation view of another embodiment of a wireless microphone adapter showing the adaptor in use with a wireless microphone.

FIGS. 13A and 13B illustrate embodiments of a wireless microphone adapter 1350 that may be placed in microphone holder 1304 (FIG. 13) in place of an external microphone. Wireless microphone adapter 1350 has cylinder 1352 that is received by microphone holder 1304. Cylinder 1352 is attached to plate 1354 along its longitudinal axis. In the embodiment shown in FIG. 13A, cylinder 1352 is attached to plate 1354 via one or more brackets 1356. Alternatively, as in FIG. 13B, it is possible to use another means of attachments, such as welds, or adhesives.

FIG. 13B illustrates a wireless microphone 1372 attached to a wireless microphone adapter 1350. Plate 1354 has a fastener 1358 securely attached to the outer side of plate 1354. The outer side is the side opposite cylinder 1352. The fastener is preferably a "hook and loop" type of fastener, such as VELCRO, or an equivalent. Wireless microphone 1372 is attached to plate 1364. Plate 1364 has a complementary fastener 1368 mounted thereon. Fastener 1368 engages with fastener 1358 of the wireless microphone adapter 1350, thereby providing a secure mounting for a wireless microphone, having the advantage of quick attachment and removal.

Figure 14A:
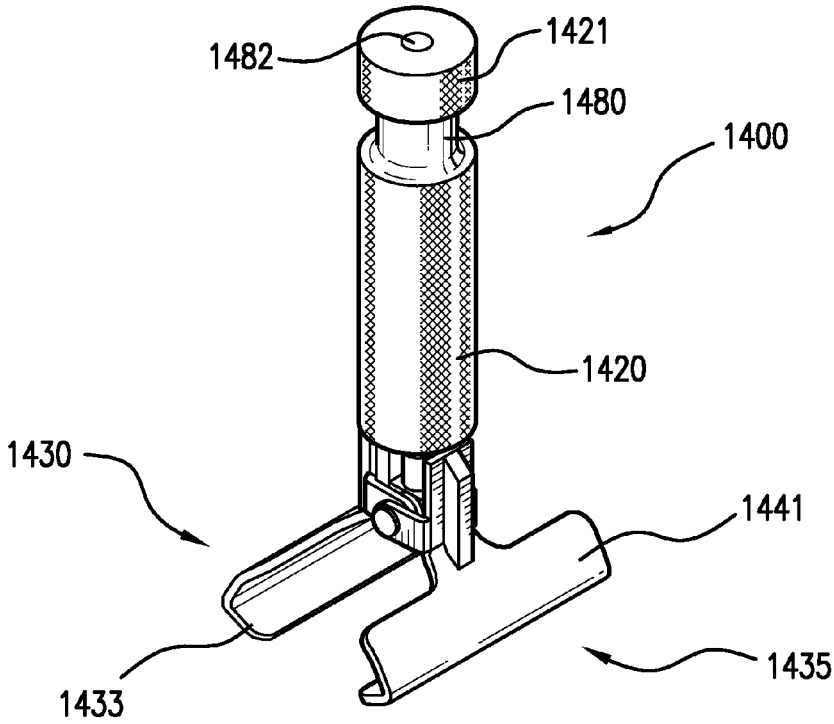
FIG. 14A is a perspective view of a portable light adapter.
Figure 14B:
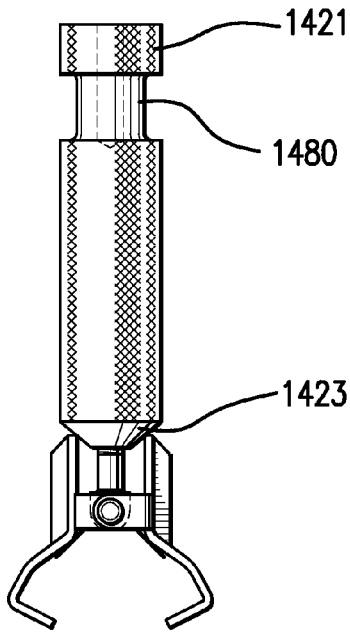
FIG. 14B is a plan view of the portable light adapter of FIG. 14A.
Figure 14C:
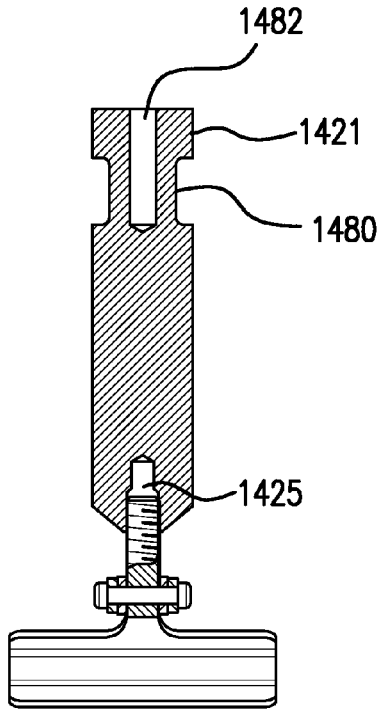
FIG. 14C is a sectional view of the portable light adapter of FIG. 14A.

FIGS. 14A, 14B, and 14C illustrate an alternate embodiment of mounting bracket 1400 used in conjunction with supporting small, portable accessory lighting on stand-alone systems, cameras and camcorders. Similar to the different embodiments for a microphone holder previously discussed, this mounting bracket for portable lighting is designed for two sizes to accommodate lightweight and heavy lighting loads. In this embodiment of the mounting bracket 1400 (also referred to as a portable light adapter), body 1420 is approximately 2¼ inches long. Additionally, near the top of body 1420, for example, 1½ inch from the top of body 1420, the diameter reduces to ½ inch for a length of ½ inch to form channel 1480 and then the diameter increases to the original diameter, forming circular end 1421. Body 1420 is preferably constructed from aluminum, although alternative materials such as stainless steel may be used.

In the light-duty embodiment of portable light adapter 1400, body 1420 is about ¾ inch in diameter. About 3/16 inch from the top, body 1420 tapers inward at about a 37 degree angle until the diameter at the top of the tapered end 1423 is about ¼ inch. The top of the tapered end 1423 is centered about the diameter of body 1420. At the top of tapered end 1423, a hole 1425, about 5/32 inch in diameter and ⅞ inch long, is drilled and tapped for a #10-32 thread. Tapered end 1423 is finished smooth to allow the ends of the support clips 130 and 135 to slide up and down tapered end 1423.

Circular body 1420 is knurled from ⅝ inch below the top of tapered end 1423 to about 1½ inch below the top of tapered end 1423. The knurled area allows an individual to firmly grasp and rotate body 1420 to open or close support clips 130 and 135. Below the knurled area, the diameter of body 1420 reduces to ½ inch for a length of ½ inch to form channel 1480. The remaining ¼ inch of body 1420 comprises the circular end 1421. At circular end 1421, a hole 1482, about ⅕ inch in diameter and ⅞ inch long is drilled and tapped for #¼-20 thread. Circular end 1421 receives a corresponding threaded end of a standard portable light fixture. The portable light fixture also clamps to channel 1480 via a set screw (not shown). Support clips 130 and 135 attach to body 1420 using adjustment screw 122, set pin 124 and spring 126 as earlier described. Using this embodiment, an individual is able to attach portable lighting onto almost any support structure up to 1 inch in diameter or width that may not have been feasible without mounting bracket 1400.

In the heavy-duty embodiment of the portable light adapter 1400, body 1420 is about 1 inch in diameter. About ¼ inch from the top, body 1420 tapers inward at about a 34 degree angle until the diameter at the top of the tapered end 1423 is about ¼ inch. The top of the tapered end 1423 is centered about the diameter of body 1420. At the top of tapered end 1423, a hole 1425, about ⅕ inch in diameter, is drilled the entire length of body 1420 and tapped for a #¼-20 thread. Tapered end 1423 is finished smooth to allow the ends of the support clips 130 and 135 to slide up and down tapered end 1423. Circular body 1420 is knurled from ⅝ inch below the top of tapered end 1423 to about 1½ inch below the top of tapered end 1423. The knurled area allows an individual to firmly grasp and rotate body 1420 to open or close support clips 130 and 135. Below the knurled area, the diameter of body 1420 reduces to ½ inch for a length of ½ inch to form channel 1480. The remaining ¼ inch of body 1420 comprises the circular end 1421. Circular end 1421 receives a corresponding threaded end of a standard portable light fixture. The portable light fixture also clamps to channel 1480 via a set screw. Support clips 130 and 135 attach to body 1420 using adjustment screw 122, set pin 124 and spring 126 as earlier described. Using this embodiment, an individual is able to attach portable lighting onto almost any support structure up to 2 inches in diameter or width that may not have been feasible without mounting bracket 1400.

Figure 15A:
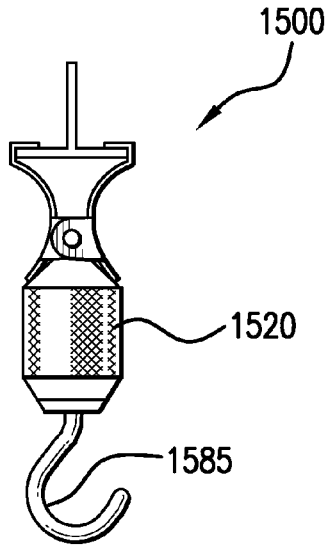
FIG. 15A is an elevation view of a mounting bracket with a hook.
Figure 15B:
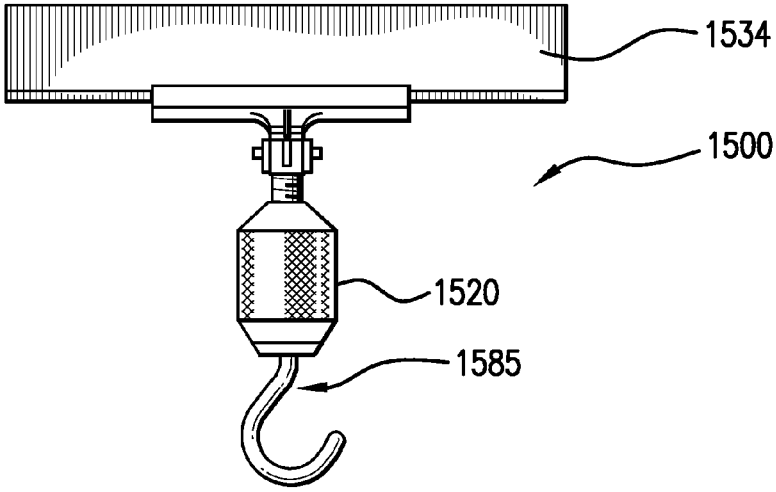
FIG. 15B is an alternate elevation view of a mounting bracket with a hook attached to a support structure.
Figure 15C:
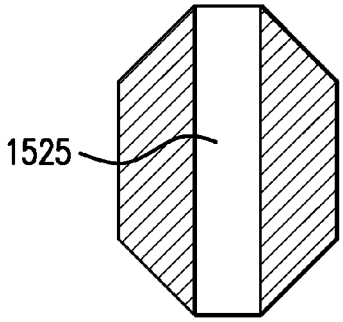

FIGS. 15A, 15B, and 15C illustrate an alternate embodiment of the mounting bracket to hold light-weight objects. In this embodiment, body 1520 is based on body 120 of the embodiment of FIG. 1. However, body 1520 does not include the threaded end 121 that is present in the embodiment shown in FIG. 1. Hole 1525 is drilled through the entire body allowing a hook 1585 to threadedly attach to the mounting bracket 1500. Alternatively, body 1520 with hole 1525 and hook 1585 may be molded from plastic in a unibody fashion. Support clips 130 and 135 would attach to this embodiment as previously discussed.

Figure 16:
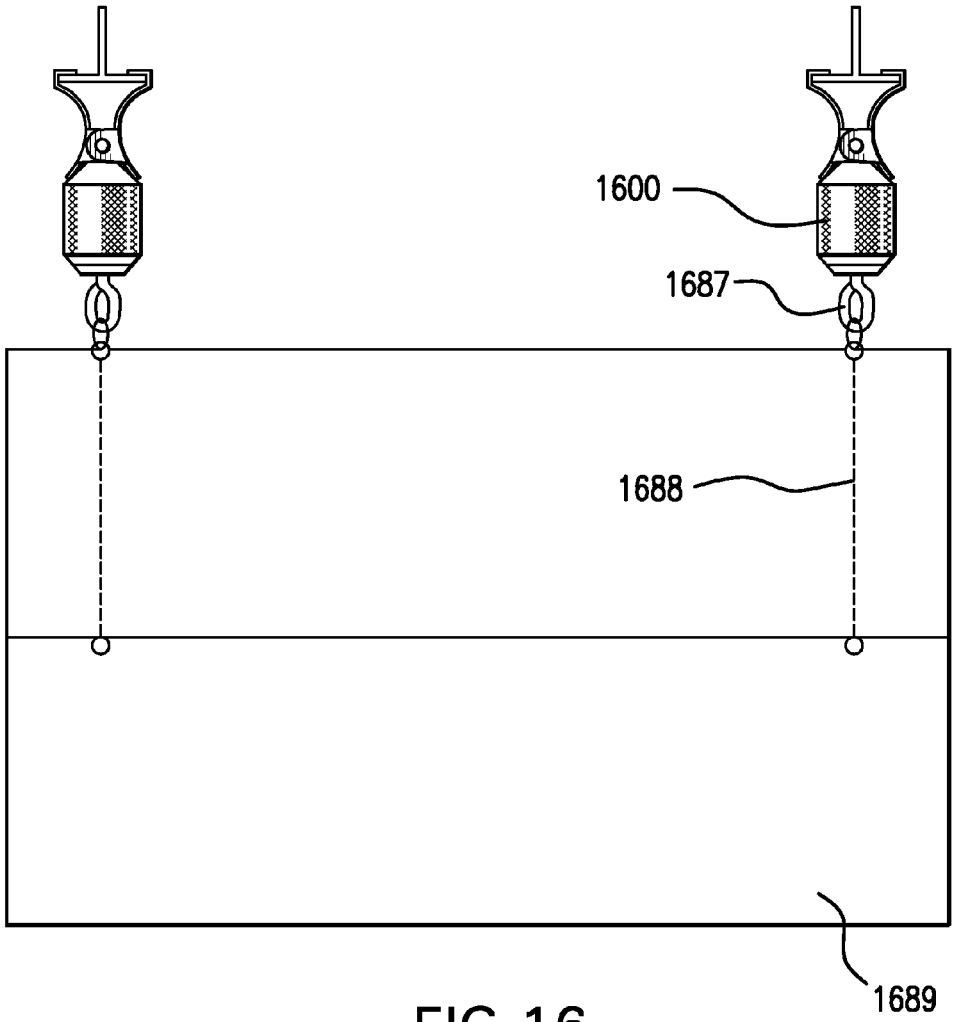
FIG. 16 is an elevation view of a mounting bracket with a picture support hook holding a picture with a chain.

FIG. 16 illustrates use of the mounting bracket shown in FIGS. 15A, 15B and 15C, here indicated as 1600. In this embodiment, mounting bracket 1600 (also referred to as a picture support hook) is used to hang pictures, a sign, or the like, referenced as 1689, from a drop ceiling using a suspension means of chain 1688. Note that cable, rope, or other suitable material may be used as the suspension means without departing from the spirit of the present invention.

It is intended that some or all of the aforementioned embodiments may be part of a kit. This kit provides solutions for photographers, studio technicians, videographers, and the like, for mounting the needed accessories such as lights and microphones. Modifications and changes from the specified form of the invention herein shown and described as a preferred embodiment will occur to those skilled in the art. All such modifications and changes not departing from the spirit of the invention are intended to be embraced within the scope of the appended claims.

What is claimed is:

1. A kit for conveniently mounting audio, video, lighting, and film accessories on a support structure comprising:

A. at least one mounting bracket comprising:

(a) a body having a tapered end and a threaded end, the tapered end having a threaded hole, said threaded hole extending into said body;

(b) a threaded adjustment screw engaged in said threaded hole; and (c) a pair of opposing clamping members pivotally connected to the adjustment screw, each clamping member having a bottom end, and a jaw at the opposite end, wherein the bottom end of each clamping member slides along the tapered end of the body, thereby moving the jaw into an opened position with the adjustment screw extended and a closed position with the adjustment screw retracted;

B. at least one desk stand plate assembly for providing means for clamping the mounting bracket, the desk stand plate assembly comprising:

(a) a base plate;

(b) a support structure attached to said base plate; and (c) a fastening means for fastening the support structure to the base plate; and C. at least one adjustable mounting bracket comprising:

a circular body, having a first ball-shaped fixture at one end;

a microphone adaptor, having a second ball-shaped fixture at one end;

a universal block having a first half and a second half, and two notched ends for receiving the first and second ball-shaped fixtures; and a threaded screw having a bar knob at the distal end, said threaded screw threadably engaging the first half and second half of the universal block; thereby clamping the notches of the universal block onto each said ball-shaped fixture, and providing an adjustable mounting bracket.

2. The kit of claim 1, further comprising at least one drop ceiling light assembly comprising:

a light cover;

a curved shaft having a first end and a second end;

a mounting bracket having an adjustment screw; and a linear shaft extension having a first end and a second end; wherein the first end of the linear shaft extension is attached to a ceiling-mounted electrical box, and the second end of the linear shaft extension is attached to the first end of the curved shaft, the light cover is attached to the second end of the curved shaft, and the mounting bracket is attached to the light cover, thereby providing a means for quick installation a multiple ceiling-mounted light.

3. The kit of claim 1, further comprising at least one clamp for mounting a mounting bracket, the clamp comprising:

a C-shaped frame, having an elongated segment, and first and second short segments a threaded hole in the first short segment of the C-shaped frame;

a threaded rod protruding through said threaded hole, said threaded rod having a handle on one end, and a flat base on the other end; and a base plate connected to the outer side of the elongated segment of the C-shaped frame.

4. The kit of claim 1, further comprising at least one wireless microphone adapter comprising a cylinder, said cylinder attached to a plate along the longitudinal axis of the cylinder, said cylinder having a fastener securely attached to the outer side of the plate, whereby the fastener receives a complementary fastener of a wireless microphone, thereby providing a secure mounting for a wireless microphone.

5. The kit of claim 1, further comprising at least one shoe mount adapter comprising a plate;

a microphone holder attached to said plate;

a cable holder attached to said microphone holder;

a shoe mount guide attached to said plate; and a shoe mount attached to said plate, opposite of said shoe mount guide;

whereby the shoe mount adapter provides means for attaching a shoe mount device and a microphone, and fastening a microphone cable, conveniently to a shoe mount of a camera.

* * * * *